US011371183B2

(12) United States Patent
Ham et al.

(10) Patent No.: US 11,371,183 B2
(45) Date of Patent: Jun. 28, 2022

(54) CLOTHES CARE APPARATUS

(71) Applicant: Samsung Electronics Co., Ltd., Suwon-si (KR)

(72) Inventors: Yeonsoo Ham, Suwon-si (KR); Jiho Seo, Suwon-si (KR); Jaebok Lee, Suwon-si (KR); Hojin Lee, Suwon-si (KR); Seokho Ju, Suwon-si (KR); Yongjun Hwang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/009,274

(22) Filed: Sep. 1, 2020

(65) Prior Publication Data

US 2021/0062404 A1 Mar. 4, 2021

(30) Foreign Application Priority Data

Sep. 2, 2019 (KR) ..... 10-2019-0108402

(51) Int. Cl.
*D06F 73/02* (2006.01)
*D06F 71/04* (2006.01)
(Continued)

(52) U.S. Cl.
CPC ..... *D06F 73/02* (2013.01); *D06F 71/04* (2013.01); *D06F 71/20* (2013.01); *D06F 71/34* (2013.01)

(58) Field of Classification Search
CPC ..... D06F 73/00; D06F 73/02; D06F 71/04; D06F 71/16–28; D06F 71/285;
(Continued)

(56) References Cited

U.S. PATENT DOCUMENTS 2,807,396 A * 9/1957 Davis ..... D06F 71/34 223/57
3,471,067 A * 10/1969 Stewart ..... D06F 71/08 223/57
(Continued)

FOREIGN PATENT DOCUMENTS

JP 7-124393 5/1995
JP 2004-236778 8/2004
(Continued)

OTHER PUBLICATIONS

International Search Report dated Dec. 28, 2020 in International Patent Application No. PCT/KR2020/011436.

*Primary Examiner* — Ismael Izaguirre
(74) *Attorney, Agent, or Firm* — Staas & Halsey LLP

(57) ABSTRACT

A clothes care apparatus including a main body including a clothes care room, a support device arranged inside the clothes care room and configured to support clothes, and a steam generating device configured to supply steam into the clothes care room, wherein the support device includes a first support member, and a second support member and a third support member that are arranged in a first direction with respect to the first support member, the first support member and each of the second support member and the third support member are separated by a first separation distance, the second support member and the third support member are separated by a second separation distance in a second direction which is perpendicular to the first direction, wherein each of the first separation distances, and the second separation distance are variable to, when the clothes are supported on the support device and steam is supplied by the steam generating device, prevent wrinkles.

19 Claims, 21 Drawing Sheets

(51) Int. Cl.
*D06F 71/20* (2006.01)
*D06F 71/34* (2006.01)

(58) Field of Classification Search
CPC ..... D06F 71/34; A47G 25/44; D06C 5/00; D06C 15/00
See application file for complete search history.

(56) References Cited

U.S. PATENT DOCUMENTS 3,613,969 A * 10/1971 Forse ..... D06F 71/20 223/37
3,632,041 A * 1/1972 Radford ..... D06F 71/34 239/128
3,749,292 A * 7/1973 Engelbart ..... D06F 71/26 223/57
4,728,015 A * 3/1988 Holzapfel ..... D06F 73/00 223/70
5,305,484 A * 4/1994 Fitzpatrick ..... D06F 73/02 223/70
5,722,572 A * 3/1998 Pessina ..... D06F 71/20 223/52
7,191,921 B2 * 3/2007 Redlin ..... D06F 73/00 223/70
9,410,281 B2 * 8/2016 Roselle ..... A47G 25/442
2012/0018461 A1 * 1/2012 Azizian ..... D06F 73/02 223/66
2012/0291823 A1 * 11/2012 Trent ..... B08B 3/00 134/115 R
2016/0215440 A1 7/2016 Burger et al.
2016/0309936 A1 10/2016 Roselle et al.

FOREIGN PATENT DOCUMENTS

KR 10-0322173 3/2002
KR 10-0628587 9/2006
KR 10-2014-0016096 2/2014
KR 10-1708314 2/2017
KR 10-1926415 12/2018

* cited by examiner

CLOTHES CARE APPARATUS

CROSS-REFERENCE TO RELATED APPLICATIONS

This application is based on and claims priority under 35 U.S.C. § 119 to Korean Patent Application No. 10-2019-0108402, filed on Sep. 2, 2019 in the Korean Intellectual Property Office, the disclosure of which is incorporated herein by reference.

BACKGROUND

Field

The disclosure relates to a clothes care apparatus, and more particularly, to a clothes care apparatus for caring clothes by ironing the clothes.

Description of the Related Art

In general, a clothes care apparatus refers to a device that processes laundry by washing or drying. The clothes care apparatus may further include a steam generating device and a hot air supply device for supplying hot air to an accommodation space in which clothes are accommodated to remove wrinkles of the clothes.

Steam may be supplied to the clothes through the steam generating device to remove wrinkles of the clothes. In this case, a plurality of fixing portions for fixing the clothes to provide the clothes with tension may be arranged.

The clothes may be fixed to the plurality of fixing portions, and then supplied with steam so that wrinkles may be removed. However, in this case, steam may not be supplied to the whole area of the clothes due to the clothes being fixed to the plurality of fixing portions, or some wrinkles may not be removed since the clothes overlap each other.

SUMMARY

Therefore, it is an object of the disclosure to provide a clothes care apparatus capable of increasing the efficiency of wrinkle removal and allowing a user to easily fix clothes to the clothes care apparatus.

Additional aspects of the disclosure will be set forth in part in the description which follows and, in part, will be obvious from the description, or may be learned by practice of the disclosure.

Therefore, it is an aspect of the disclosure to provide a clothes care apparatus including: a main body including a clothes care room; a support device arranged inside the clothes care room and configured to support clothes; and a steam generating device configured to supply steam into the clothes care room, wherein the support device includes a first support member, and a second support member and a third support member that are arranged in a first direction with respect to the first support member, a first separation distance formed between the first support member and each of the second support member and the third support member in the first direction is provided to be variable, and a second separation distance formed between the second support member and the third support member in a direction perpendicular to the first direction is provided to be variable.

The second support member may advance in a third direction formed between the first direction and the second direction and retract in a direction opposite to the third direction, and the third support member advances in a fourth direction that is line-symmetry to the third direction about the first direction and retracts in a direction opposite to the fourth direction.

When the second support member and the third support member may move in the third direction and the fourth direction, respectively, the first separation distance and the second separation distance may be increased.

The first support member may include a body configured to support a top and a first fixing portion arranged on a side of the body in a direction opposite to the first direction such that a front portion of the top is fixed to the body.

The first fixing portion may include a first fixture and a first elastic member elastically supporting the first fixture such that the first fixture is biased in the first direction, and the first fixture may be provided such that front portion of the clothes is fixed between the first fixture and the body.

A front surface of the first fixture and a front surface of the body may be arranged to be coplanar with each other.

An upper portion of the body may be provided to support a collar side of the top thereon, and the first support member may include a fourth support member arranged on a side of the upper portion of the body in the first direction so as to advance in the first direction and retract in the direction opposite to the first direction.

The first support member may further include a second fixing portion arranged on a side of the upper portion of the body in the direction opposite to the first direction such that a front portion of the collar side of the top is fixed to the upper portion of the body.

A front portion of the body may include a flat surface, and the body may further include a support groove arranged at an upper side of the flat surface such that at least a portion of a bottom is inserted into the support groove and supported.

The support device may be provided to advance in the direction opposite to the first direction and retract in the first direction, and may be provided to advance in the direction opposite to the first direction such that the flat surface of the body is adjacent to an inner surface of the main body.

The main body may further include a press plate that is arranged on the inner surface of the main body and provided to come in contact with the flat surface of the body when the flat surface of the body is moved in a direction toward the inner surface.

The main body may include a sleeve fixing portion configured to fix a sleeve side of the clothes, wherein the sleeve fixing portion may advance in a fourth direction perpendicular to the first direction and the second direction and retract in a direction opposite to the fourth direction inside the main body.

The sleeve fixing portion may include a central body and a sleeve fixture provided to be separable from the central body, and the sleeve fixing portion may allow a sleeve of the clothes to be arranged and fixed between the central body and the sleeve fixture.

The support device may further include a driving unit allowing the second support member and the third support member to be translated, the driving unit may include a motor and a driving body provided to advance in the first direction and retract in a direction opposite to the first direction by the driving of the motor, and the second support member may advance in the third direction and retract in a direction opposite to the third direction and the third support member may advance in the fourth direction and retract in a direction opposite to the fourth direction in linkage with the driving body.

The driving body may include rails extending in the third direction and the fourth direction, the driving body may include a slit, each of the second support member and the third support member may include a protrusion inserted into the slit, and the second support member and the third support member, while having the respective protrusions guided by the slits, may alternate advancing in the third direction and retracting in the direction opposite to the third direction and may alternate advancing in the fourth direction and retracting in the direction opposite to the fourth direction, respectively, along the rails.

It is another aspect of the disclosure to provide a clothes care apparatus including: a main body including a clothes care room; a support device arranged inside the clothes care room and configured to support clothes; and a steam generating device configured to supply steam into the clothes care room, wherein the support device may include a first support member provided to support a top and a bottom, and a second support member arranged in a first direction with respect to the first support member and provided to press the top from an inside of the top, and the first support member may include a support groove arranged on a side of the first support member in a direction opposite to the first direction and into which the bottom is inserted and supported, wherein the support device may be provided to advance in the direction opposite to the first direction and retract in the first direction.

The clothes care apparatus may further include a third support member arranged in a second direction perpendicular to the first direction with respect to the second support member, and the second support member may advance in a third direction between the first direction and the second direction and retract in a direction opposite to the third direction, and the third support member may advance in a fourth direction that is line-symmetry to the third direction about the first direction and retract in a direction opposite to the fourth direction.

The first support member may further include a fixing portion arranged at a lower side of the support groove and allowing a front portion of the top to be fixed to the first support member.

The support device may further include: a first driving unit configured to transfer a driving force to the second support member and the third support member such that the second support member and the third support member are moved in the third direction and the fourth direction, respectively, and a second driving unit configured to transfer a driving force to the support device such that the support device advances in the direction opposite to the first direction and retracts in the first direction.

It is another aspect of the disclosure to provide a clothes care apparatus including: a main body including a clothes care room; a support device arranged inside the clothes care room and configured to support clothes; and a steam generating device configured to supply steam into the clothes care room, wherein the support device may include a first support member supporting clothes, a second support member arranged in a first direction with respect to the first support member, and a third support member arranged in a second direction perpendicular to the first direction with respect to the second support member, the second support member may advance in a third direction between the first direction and the second direction and retract in a direction opposite to the third direction, and the third support member may advance in a fourth direction that is line-symmetry to the third direction about the first direction and retract in a direction opposite to the fourth direction.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
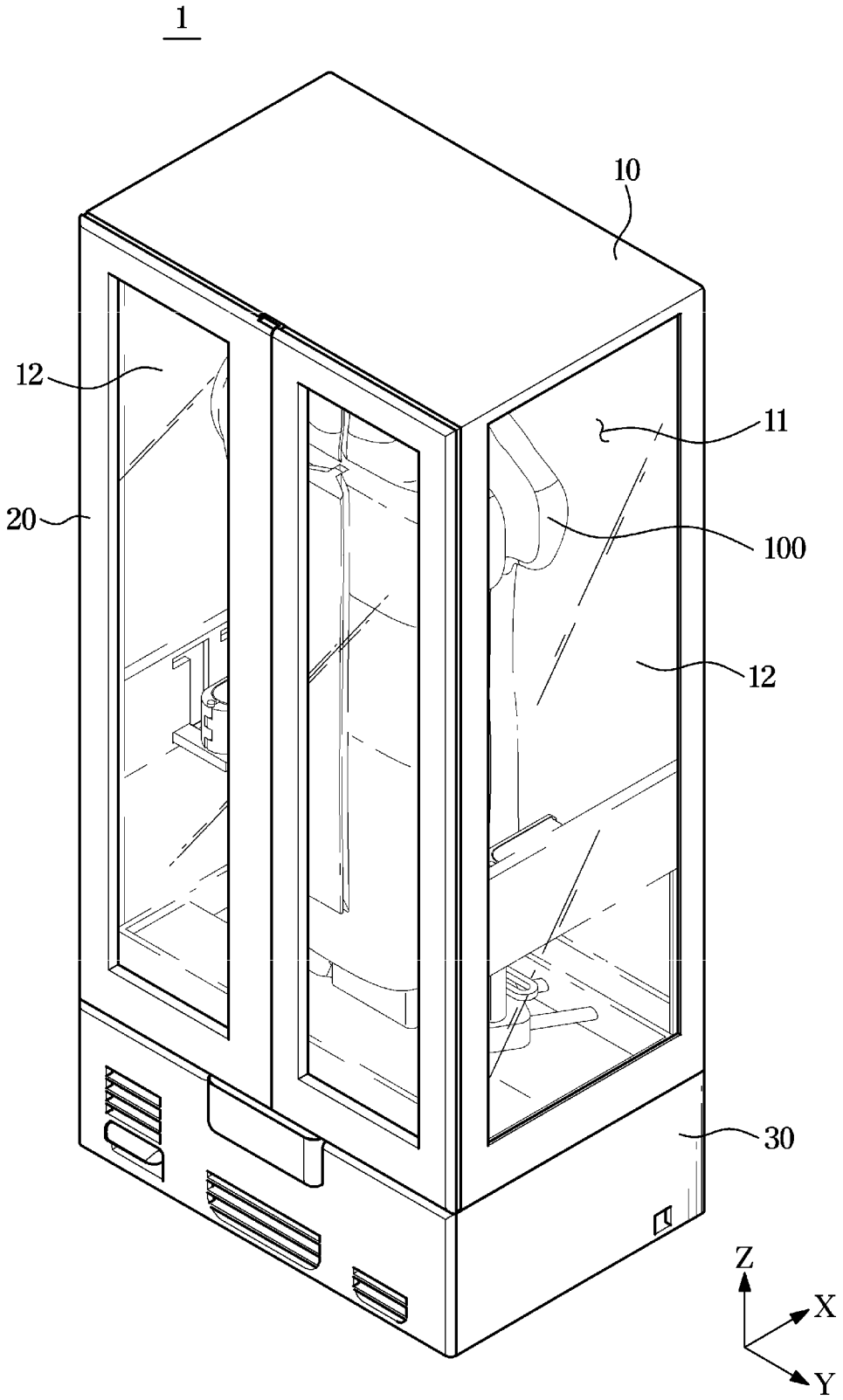
FIG. 1 is a view illustrating a clothes care apparatus according to an embodiment of the disclosure.

The embodiments set forth herein and illustrated in the configuration of the present disclosure are only the most preferred embodiments and are not representative of the full the technical spirit of the present disclosure, so it should be understood that they may be replaced with various equivalents and modifications at the time of the disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "~and/or~," or the like.

The terms "front", "rear", "upper", "lower", "top", and "bottom" as herein used are defined with respect to the drawings, but the terms may not restrict the shape and position of the respective components.

Hereinafter, embodiments according to the disclosure will be described in detail with reference to the accompanying drawings.

Figure 2:
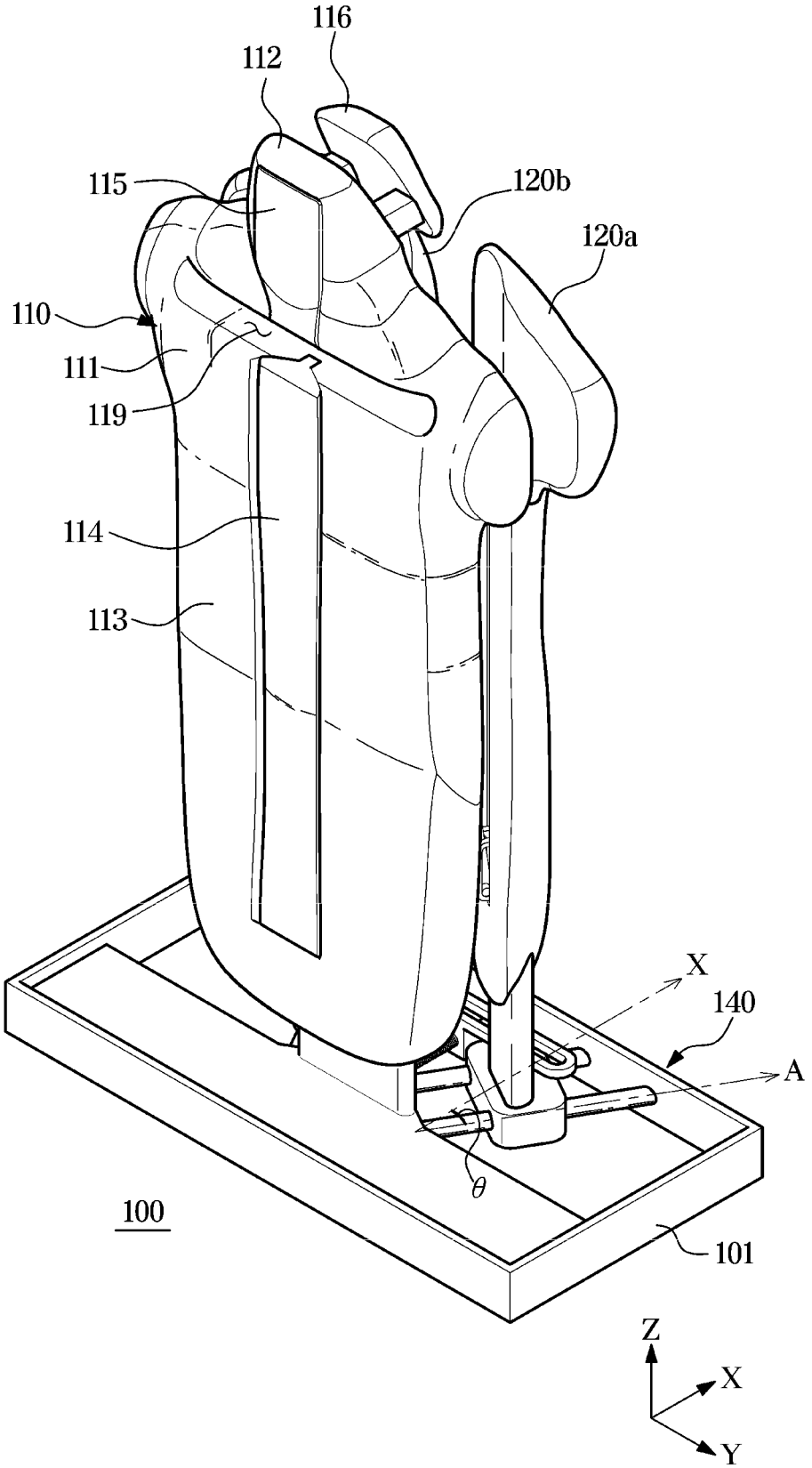
FIG. 2 is a view illustrating a front surface of a support device of the clothes care apparatus according to the embodiment of the disclosure.
Figure 3:
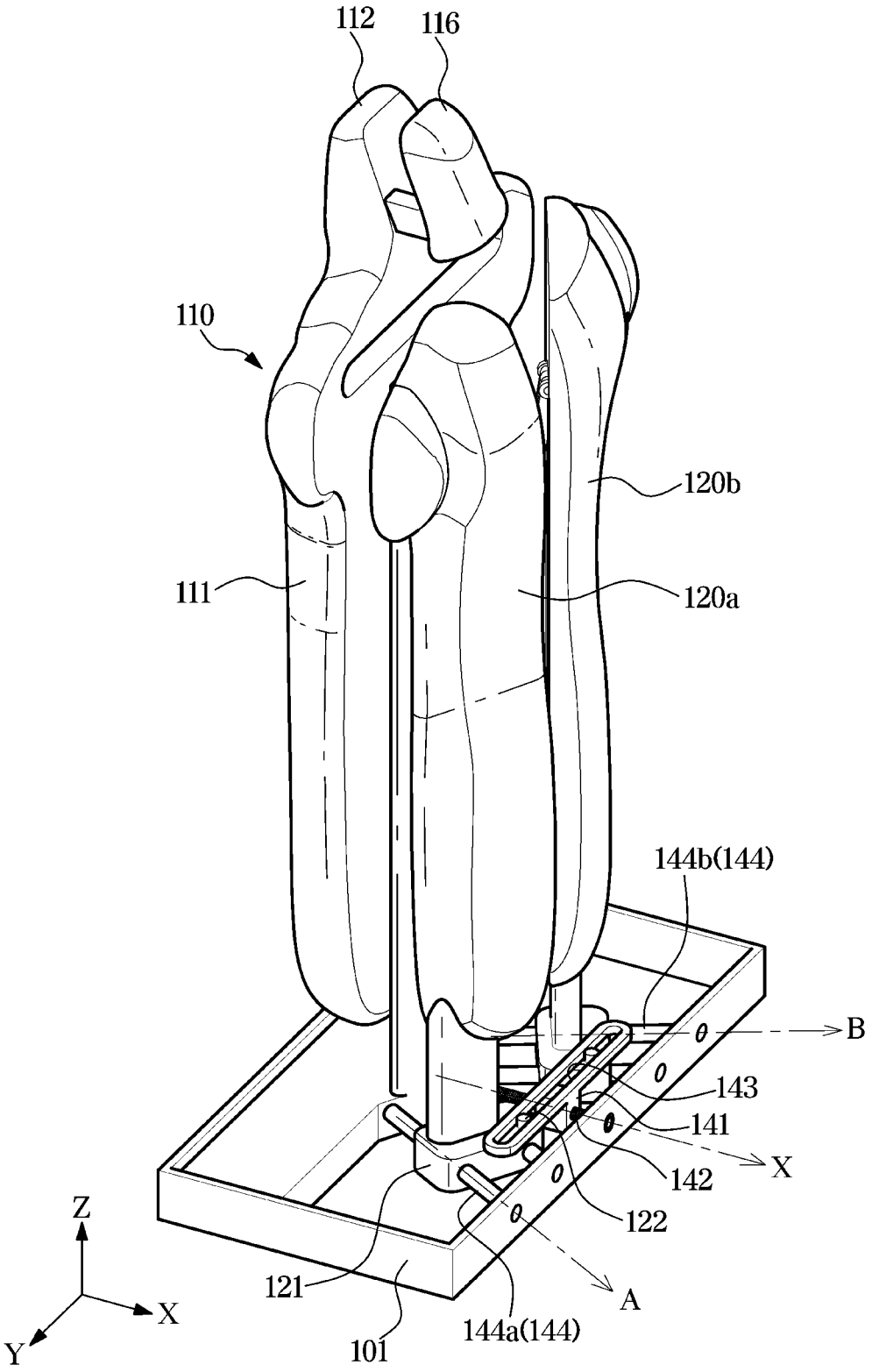
FIG. 3 is a view illustrating a rear surface of the support device of the clothes care apparatus according to the embodiment of the disclosure.
Figure 4:
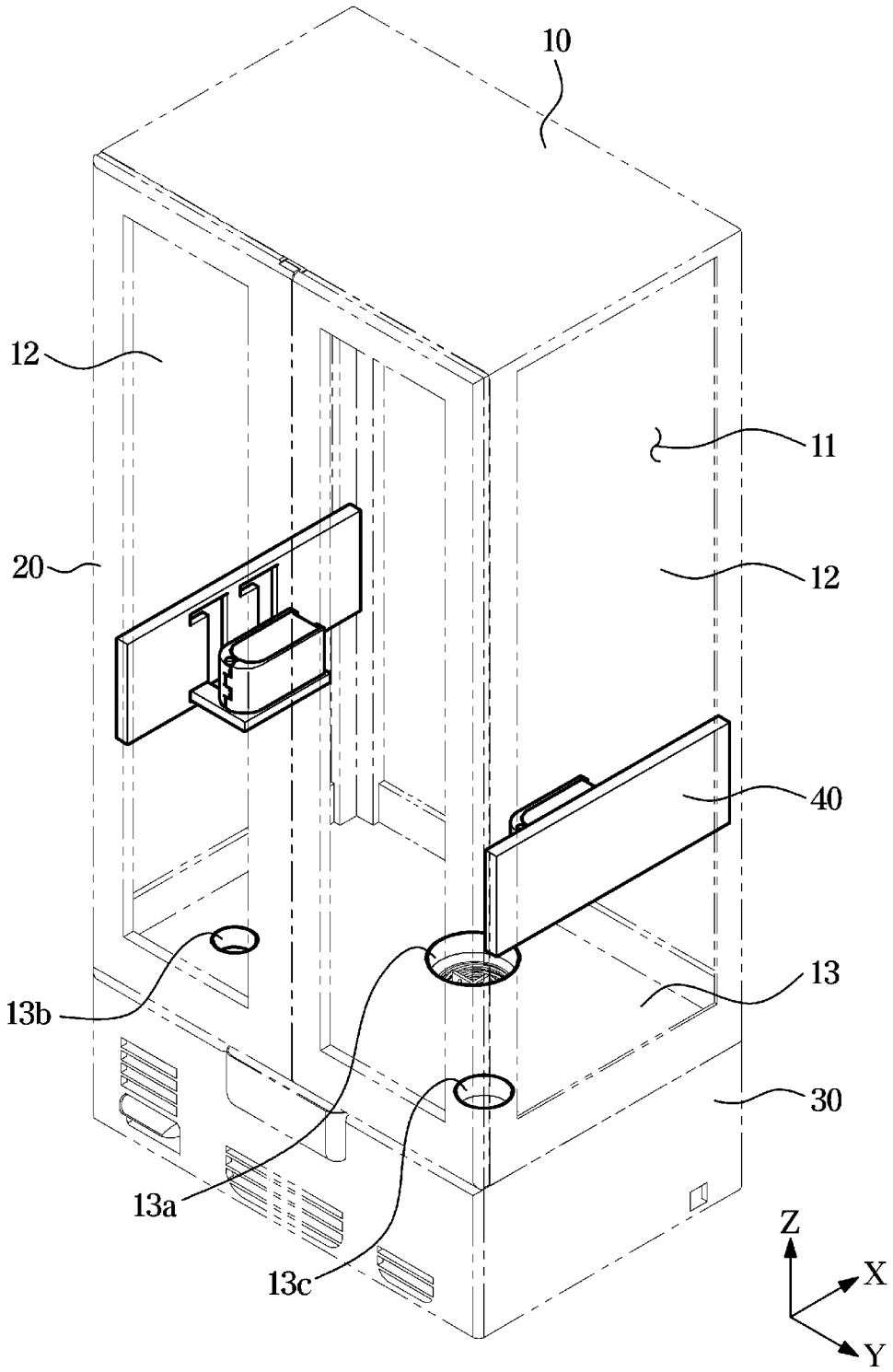
FIG. 4 is a view illustrating a main body of the clothes care apparatus shown in FIG. 1.
Figure 5:
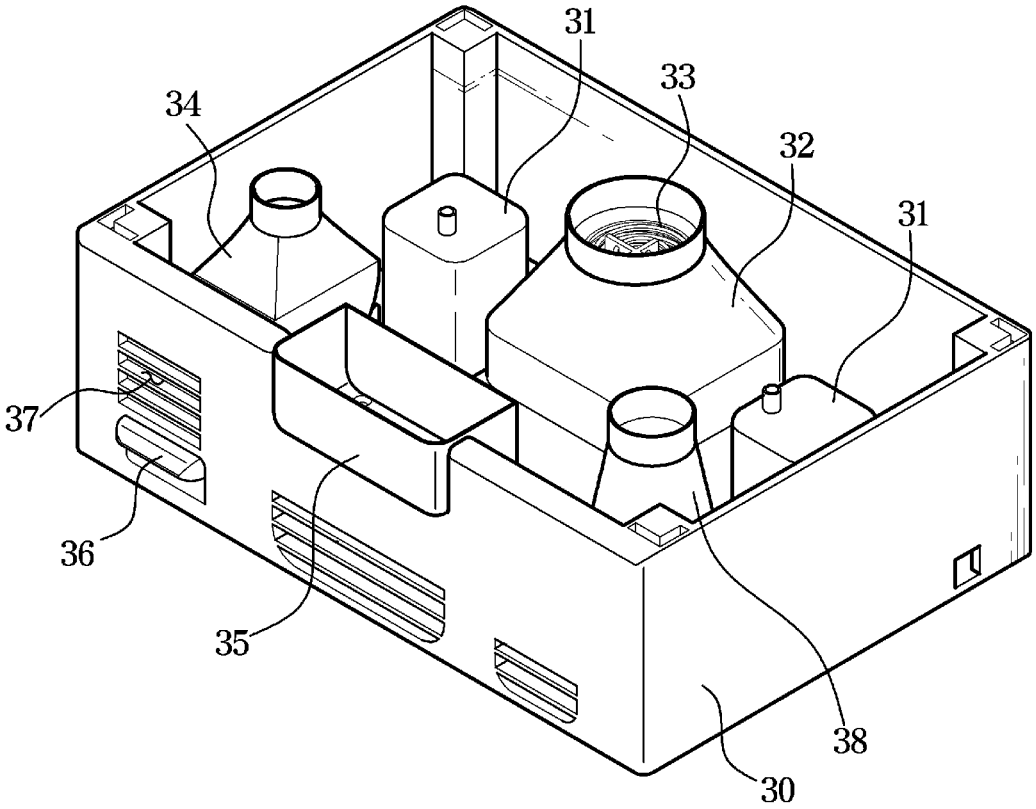
FIG. 5 is a view illustrating the inside of a machine room of the clothes care apparatus shown in FIG. 1.

FIG. 1 is a view illustrating a clothes care apparatus according to an embodiment of the disclosure, FIG. 2 is a view illustrating a front surface of a support device of the clothes care apparatus according to the embodiment of the disclosure, FIG. 3 is a view illustrating a rear surface of the support device of the clothes care apparatus according to the embodiment of the disclosure, FIG. 4 is a view illustrating a main body of the clothes care apparatus shown in FIG. 1, and FIG. 5 is a view illustrating the inside of a machine room of the clothes care apparatus shown in FIG. 1.

Referring to FIG. 1, a clothes care apparatus 1 includes a main body 10 forming the external appearance thereof, a door 20 rotatably coupled to the main body 10, a clothes care room 11 provided inside the main body 10 to accommodate and care clothes, a support device 100 provided inside the clothes care room 11 to mount clothes thereon, and a machine room 30 provided with a steam generating device 31 provided to supply steam into the clothes care room 11 (See FIG. 5).

The main body 10 may be provided with the clothes care room 11 therein, and have a hexahedral shape with one side open. An opening may be formed on the front side of the body 10. The door 20 is installed on the opening. The door 20 is rotatably coupled to the opening of the main body 10 to open and close the clothes care room 11. Although not shown, the door 20 may be installed through a connecting member, such as a hinge or a link.

When the rear direction in the front and rear side direction is defined as a first direction X, the opening of the main body 10 is open in a direction opposite to the first direction X, and the door 20 may be arranged on a side of the main body 10 in a direction opposite to the first direction X.

Referring to FIGS. 2 and 3, the support device 100 may include a first support member 110 on which clothes is mounted and a second support member 120*a* and a third support member 120*b* that are arranged in the first direction X with respect to the first support member 110 in.

The support device 100 may include a frame 101 supporting the first support member 110, the second support member 120*a*, and the third support member 120*b*. The frame 101 supports lower sides of the first support member 110, the second support member 120*a*, and the third support member 120*b* and allow the support device 110 to be fixed to the main body 10.

The second support member 120*a* may be provided to advance in a third direction A formed between the first direction X and a second direction Y perpendicular to the first direction X and retract a direction opposite to the third direction A.

In other words, the second support member 120*a* may be provided to be translated in the third direction A, which is tilted at an acute angle with respect to the first direction X. That is, the third direction A is a direction inclined with respect to the first direction X in the left-right direction at an angle of 0 degrees to 90 degrees.

The third support member 120*b* may advance in a fourth direction B which is line-symmetric to the third direction A about the first direction X and retract in a direction opposite to the fourth direction B.

Since the second support member 120*a* and the third support member 120*b* are translated in a line-symmetry about the first direction X, the second support member 120*a* and the third support member 120*b* will be described based on the second support member 120*a* moved in the third direction A between the second support member 120*a* and the third support member 120*b* forming a pair in order to avoid redundant description. The support device 100 may include a first driving unit 140 for driving the second support member 120*a* so that the second support member 120*a* is translated in the third direction A.

The first driving unit 140 may be arranged inside the frame 101.

The first driving unit 140 may include a drive motor (145 in FIG. 10), a shaft 142 connected to the drive motor 145, and a driving body 141 provided to translate in the first direction X through a rotational force generated from the drive motor 145.

The second support member 120*a* is translated in linkage with the driving body 141 by a protrusion 122 connected to the driving body 141.

The first driving unit 140 may include rails (144: 144*a* and 144*b*) extending in the third direction A and the fourth direction B (hereinafter, only one rail 144*a* extending in the third direction A will be described). The rail 144 may guide the second support member 120*a* so that the second support member 120*a* is translated in the third direction A.

The second support member 120*a* may include a guide 121 into which the rail 144 is inserted so that the second support member 120*a* is moved in the third direction A along the rail 144.

The driving body 141 may include a slit 143 into which the protrusion 122 is inserted such that the second support member 120*a* is translated in linkage with the driving body 141. The driving operation of the first driving unit 140 will be described below in detail.

The first support member 110 may support clothes. The first support member 110 may preferably be provided in a shape similar to that of a front portion of a torso including the neck, chest, and abdomen of the human body.

The second support member 120*a* may support clothes while transferring tension to the clothes. The second support member 120*a* may preferably be provided in a shape similar to that of a rear portion of the torso including the back of the human body.

The user may allow clothes to be supported on the support device 100 in such a way to put a top on the first support member 110 and the second support member 120*a*. That is, the first support member 110 and the second support member 120*a* are provided to come in contact with an inner surface of the top, and the first support member 110 and the second support member 120*a* may support the top with at least a portion of the top covered thereon.

The first support member 110 may include a body upper portion 112 provided to support a collar side of the top when the top covers the first support member 110 and the second support member 120*a*.

The body upper portion 112 is provided in the shape of a neck of the human body so that a collar side or an upper side of the top may be supported.

The first support member 110 may include a fourth support member 116 arranged in the first direction X with respect to the body upper portion 112 and provided to be translatable in the first direction X.

The fourth support member 116 may be provided to transmit tension to the collar side or the upper side of the top when the body upper portion 112 supports the collar side or the upper side of the top as described above.

The body 111 may include a flat portion 113 on a side facing in a direction opposite to the first direction X. This is to remove wrinkles on a bottom that may be supported on the first support member 110. This will be described below in detail.

As described above, the top may be supported by the first support member 110 and the second support member 120*a* in such a way to cover the first support member 110 and the second support member 120*a*. However, as for a top having an openable front portion, (e.g., a shirt) the top may not be supported by the support device 100 without being fixed to the support device 100.

In order to prevent the top from failing to be fixed to and supported by the support device 100, the first support member 110 includes a first fixing portion 114 arranged on a side of the body 111 facing in the direction opposite to the first direction X such that the front portion of the top is fixed to the body 111.

In addition, the first support member 110 may include a second fixing portion 115 that is formed on a side of the body upper portion 112 facing in the direction opposite to the first direction X to fix the front portion of the collar side of the top such that tension is efficiently transmitted to the collar side or the upper side of the top by the fourth support member 116.

The first support member 110 may be provided to support the bottom in addition to the top. The first support member 110 may include a support groove 119 into which at least a portion of the bottom is inserted such that the bottom is supported on the first support member 110.

The support groove 119 may be arranged at an upper side of the flat portion 113. The feature that the top and the bottom are supported on the first support member 110 and wrinkles are removed will be described below in detail.

Referring to FIG. 4, the main body 10 may include a sleeve fixing portion 40 for fixing a sleeve side of the clothes.

The sleeve fixing portion 40 may be provided to be translatable in a fifth direction Z perpendicular to the first direction X. That is, the sleeve fixing portion 40 may be translated in the upper and lower side direction of the main body 10.

The sleeve fixing portion 40 may be moved downward with the sleeve side of the clothes fixed thereto such that tension is transmitted to the sleeve side of the clothes.

The sleeve fixing portions 40 may be provided in a pair, and may be arranged on inner surfaces of opposite sides 12 of the main body 10, respectively.

The machine room 30 may be arranged below the main body 10, in detail, below the clothes care room 11.

The machine room 30 may be provided as a part of the main body 10 and arranged in a lower portion of the main body 10, or may be provided separately from the main body 10 and arranged below the main body 10.

Referring to FIG. 5, the machine room 30 accommodates a steam generating device 31 provided inside the machine room 30 to generate steam and a supply fan unit 32 supplying steam generated from the steam generating device 31 to the clothes care room 11.

Although not shown in the drawing, the steam generated by the steam generating device 31 may be provided to flow to the supply fan unit 32, and the steam flowing to the supply fan unit 32 may flow to the clothes care room 11 together with air by a fan arranged inside the supply fan unit 32.

The supply fan unit 32 may be provided to communicate with a supply hole 13*a* formed through a lower surface 13 of the main body 10 (see FIG. 4).

The supply hole 13*a* may be provided so that the clothes care room 11 communicates with the inside of the machine room 30.

The machine room 30 may be provided on a front surface thereof with a water supply container 35 that is detachably provided from the machine room 30. The water supply container 35 may be connected to the steam generating device 31 and store water required to generate steam by the steam generating device 31.

Steam generated inside the machine room 30 may be introduced into the clothes care room 11 through the supply hole 13*a* to be supplied to the clothes supported on the support device 100 so that that wrinkles of the clothes are removed.

The supply fan unit 32 may include a heater 33 that generates heat. The supply fan unit 32 may supply hot and dry air formed by the heater 33 to the clothes care room 11.

With such a configuration, clothes completed with wrinkle removal by steam supplied to the clothes care room 11 may be dried.

The machine room 30 may include a suction fan unit 34 provided to discharge the air inside the clothes care room 11 rendered humidified due to supply of steam.

The suction fan unit 34 may be provided to communicate with the suction hole 13*b* formed through the lower surface 13 of the main body 10 (see FIG. 4).

The suction hole 13*b* may be provided so that the clothes care room 11 and the inside of the machine room 30 communicate with each other.

The suction fan unit 34 includes a suction fan capable of sucking air, and the humid air inside the clothes care room 11 may be sucked into the suction fan unit 34 through the suction hole 13*b*.

The suction fan unit 34 may be provided to communicate with a discharge port 37 formed through the front surface of the machine room 30. Accordingly, air inside the clothes care room 11 sucked by the suction fan unit 34 may be discharged to the discharge port 37 through the suction fan unit 34 and to the clothes care apparatus 1.

A water drain container 36 may be provided on the lower portion of the suction fan unit 34 and the front surface of the machine room 30.

As the humid air remaining inside the clothes care room 11 flows into the suction fan unit 34, water in some of the air may be condensed, and the water drain container 36 may accommodate the condensed water formed as the above.

As described above, the water supply container 35 and the water drain container 36 may be provided on the front surface of the machine room 30 so as to be easily separated by the user. However, the disclosure is not limited thereto, and the water supply container 35 or the water drain container 36 may be placed anywhere as long as it can be easily gripped by the user.

The machine room 30 may include an auxiliary fan unit 38 provided to promote the flow of air inside the clothes care room 11.

The auxiliary fan unit 38 may supply air to the clothes care room 11 by an auxiliary supply fan arranged inside the auxiliary fan unit 38. Through the supply of additional air of the auxiliary fan unit 38, the fluidity of air inside the clothes care room 11 may be improved.

Accordingly, when stream is supplied by the supply fan unit 32 or dry air is supplied, the auxiliary fan unit 38 may be provided so that steam or dry air is delivered to all areas inside the clothes care room 11.

The auxiliary fan unit 38 may be provided to communicate with an auxiliary hole 13*c* formed through the lower surface 13 of the main body 10 (see FIG. 4).

The auxiliary hole 13*c* may be provided so that the clothes care room 11 and the inside of the machine room 30 communicate each other.

As such, when steam is provided to the clothes care room 11 in a state in which the door 20 is closed, steam may be uniformly delivered to the entire area of the clothes care room 11.

Accordingly, the clothes supported on the support device 100 may also have the entire area supplied with the steam, so that the efficiency of wrinkle removal may be increased.

According to the conventional wrinkle removal device, steam is supplied from the support device, so that a part of the clothes may not be supplied with the steam, or steam is provided from the outside of the support device by a nozzle or the like, so that the entire clothes may not be supplied. With the clothes care apparatus 1 according to the embodiment of the disclosure, steam may be supplied to the entire clothes care room 11 such that clothes arranged inside the clothes care room 11 may be efficiently supplied with the steam.

In particular, since the clothes care room 11 is formed as a closed space by the door 20, unlike a device for providing steam from the outside without having a clothes care room as in the conventional technology, steam may be efficiently supplied to clothes without leaking steam.

Hereinafter, the technical features in which the first support member 110 and the second support member 120*a* support clothes while transmitting tension to the clothes will be described in detail.

Figure 6:
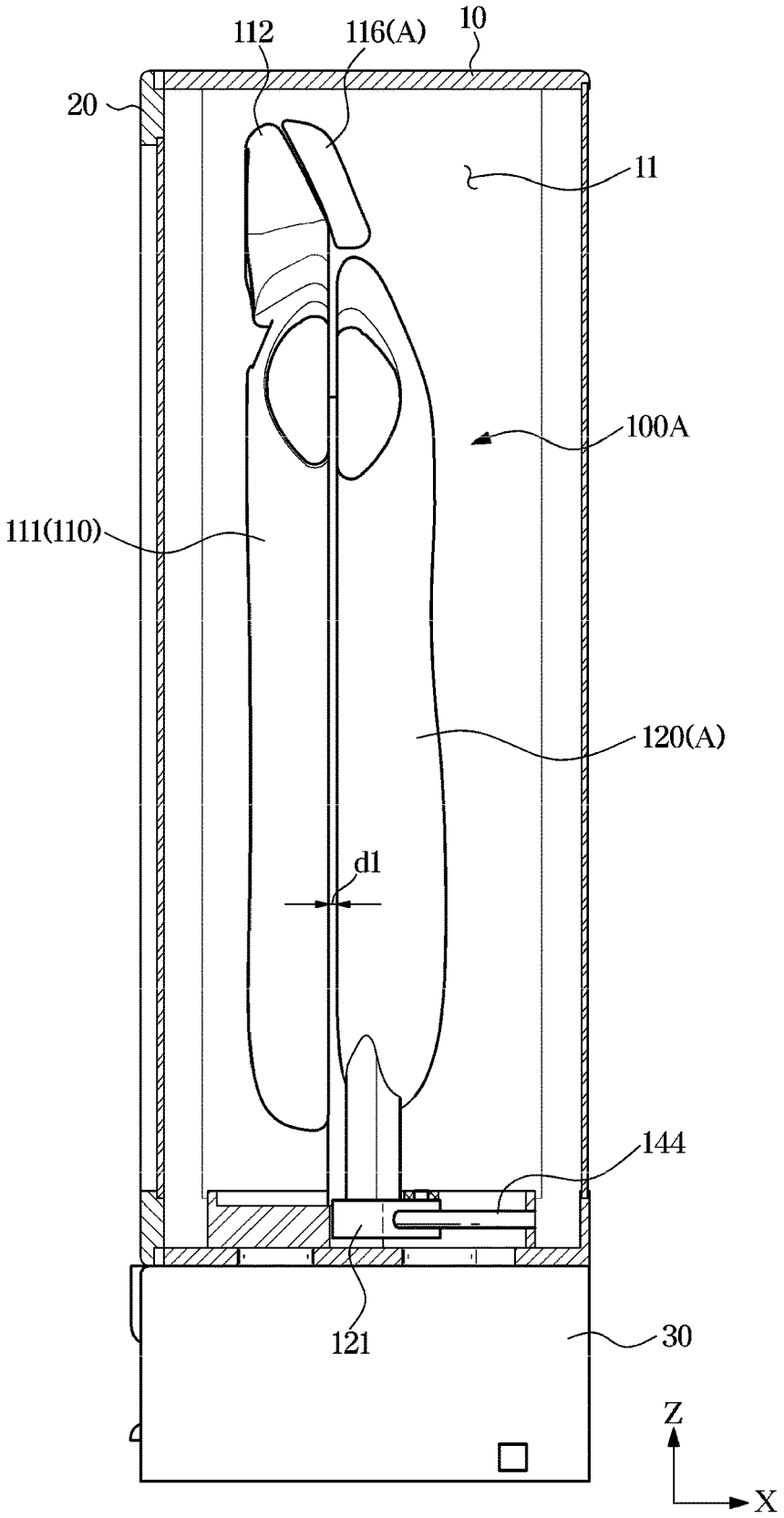
FIG. 6 is a view illustrating a side surface of the support device of the clothes care apparatus according to the embodiment of the disclosure.
Figure 7:
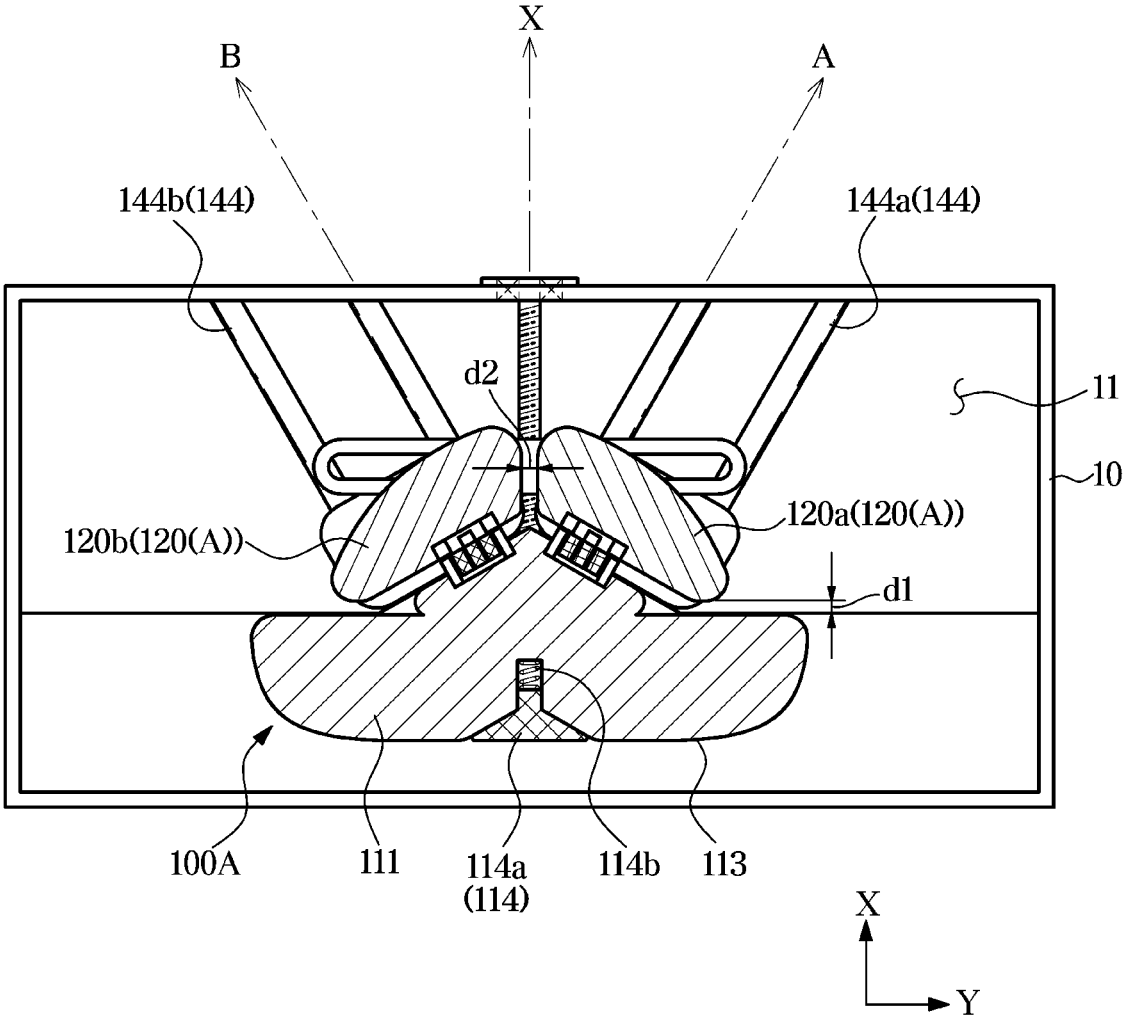
FIG. 7 is a view illustrating a cross-section of the support device shown in FIG. 6.
Figure 8:
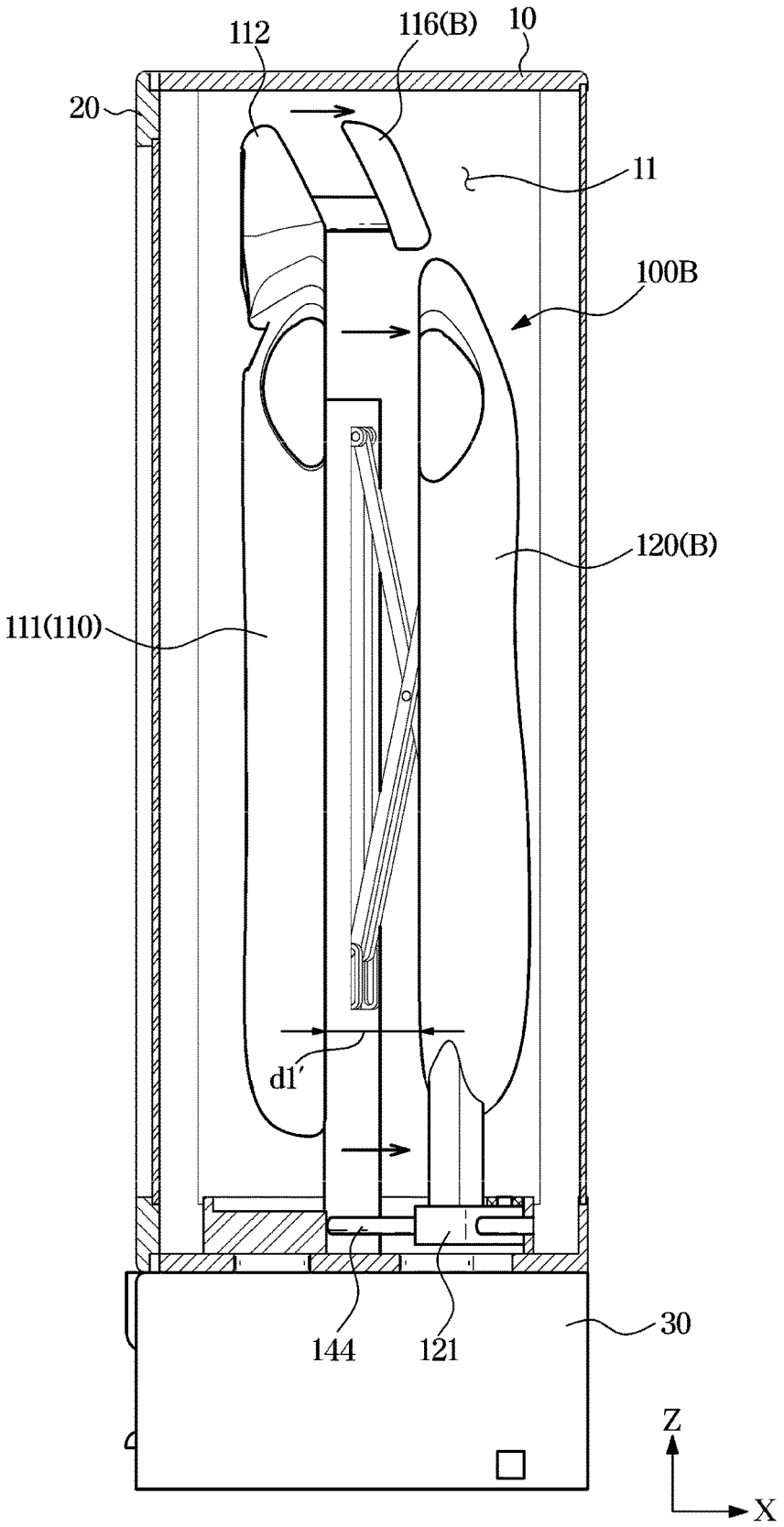
FIG. 8 is a view illustrating a state in which a second support member and a third support member are being moved in the support device of FIG. 6.
Figure 9:
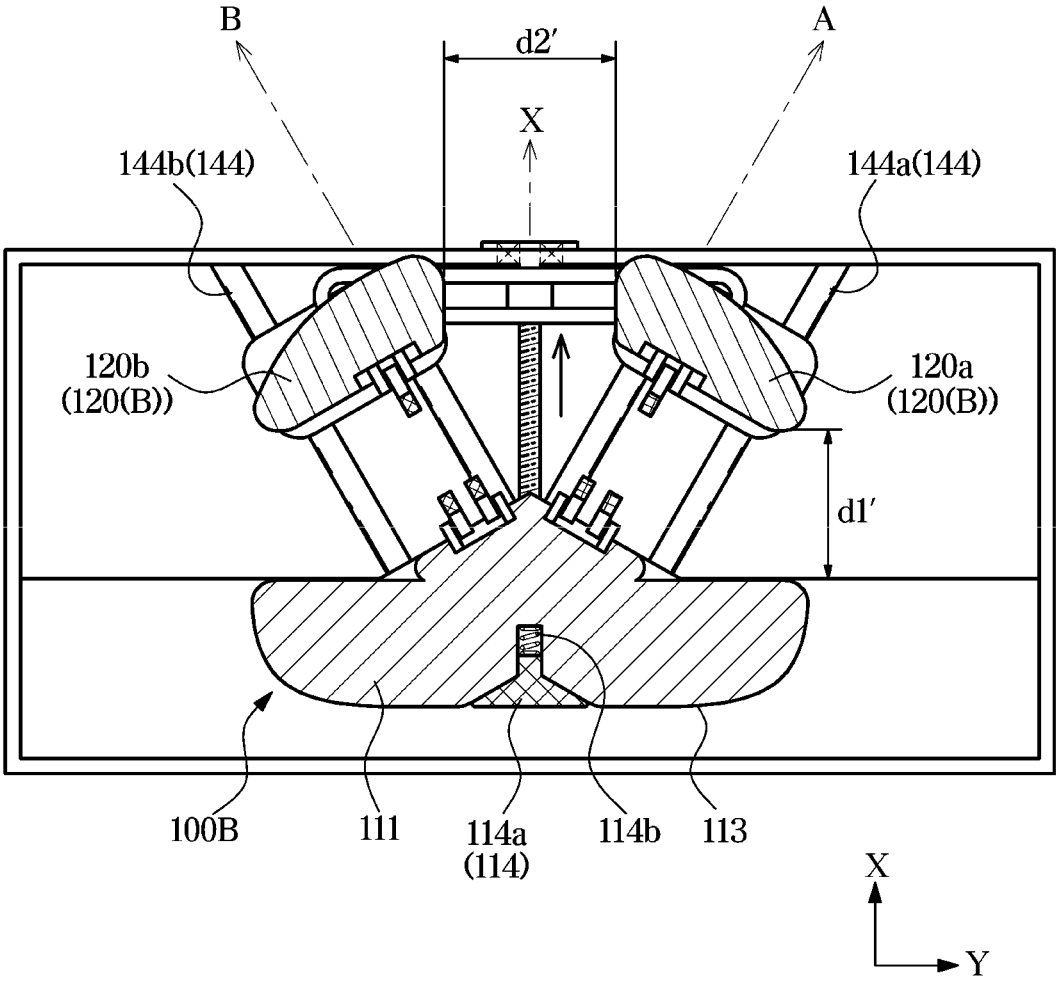
FIG. 9 is a view illustrating a cross-section of the support device shown in FIG. 8.
Figure 10:
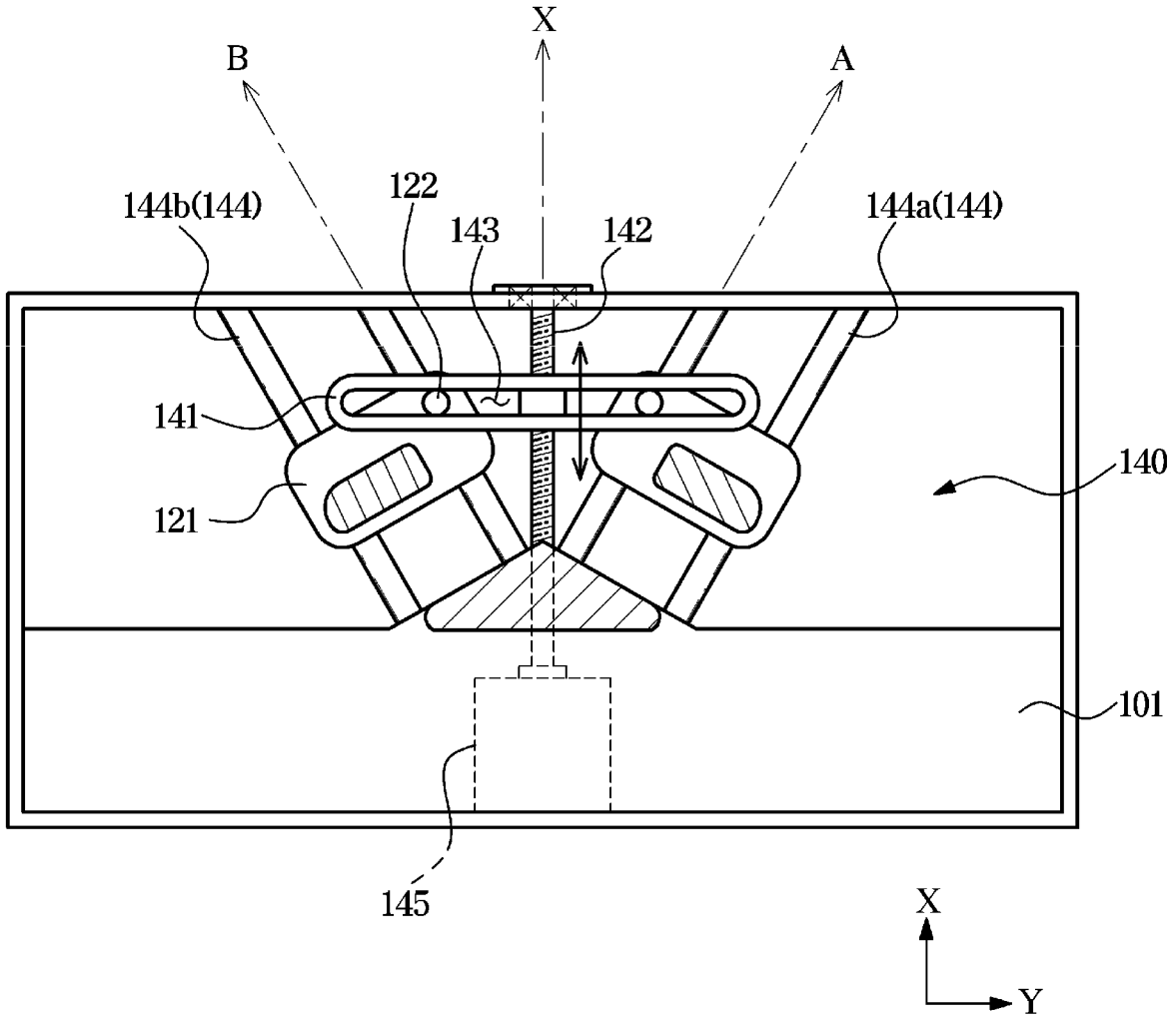
FIG. 10 is a view illustrating a driving unit of the support device according to the embodiment of the disclosure.

FIG. 6 is a view illustrating a side surface of the support device of the clothes care apparatus according to the embodiment of the disclosure, FIG. 7 is a view illustrating a cross-section of the support device shown in FIG. 6, FIG. 8 is a view illustrating a state in which a second support member and a third support member are being moved in the support device of FIG. 6, FIG. 9 is a view illustrating a cross-section of the support device shown in FIG. 8, and FIG. 10 is a view illustrating a driving unit of the support device according to the embodiment of the disclosure.

As described above, the clothes care apparatus 1 according to the embodiment of the disclosure may be provided to supply steam to the clothes care room 11 to remove wrinkles on the clothes. In this case, in order to remove the wrinkles of the clothes, steam needs to be supplied in a state in which tension is transmitted to the clothes so that the clothes are unfolded without wrinkles.

The conventional clothes care apparatus includes a plurality of holders configured to support clothes to transmit tension to the clothes, and the plurality of holders fix the clothes. In this case, the number of holders is large so that a part of the clothes is folded or overlap each other, and thus wrinkles are not removed or steam is not provided sufficiently.

In addition, the conventional clothes care apparatus has difficulty removing wrinkles on a collar of a top, or has a hassle that the user needs to fix the collar of the top to the plurality of holders to remove the wrinkles of the collar.

In addition, the conventional clothes care apparatus has difficulty removing wrinkles on a sleeve of a top or wrinkles from a sleeve to a shoulder of a top, or causes a hassle that the user needs to fix the sleeves of the top to a plurality of holders to remove the wrinkles on the sleeve of the top or the wrinkles from the sleeve to the shoulder of the top.

In addition, mostly, the conventional clothes care apparatus includes a support device for removing wrinkles of a top, thus having a difficulty in removing wrinkles of a bottom.

The clothes care apparatus 1 according to the embodiment of the disclosure includes the support device 100 including the first support member 110 and the second support member 120*a* provided to support clothes with a minimum configuration.

In addition, the first support member 110 may be provided to support not only the top but also the bottom, so that the wrinkles of the top and bottom may be easily removed through the first support member 110.

In detail, with respect to the fixed first support member 110, the second support member 120*a* may be provided to be translated in the third direction A. As described above, the clothes is fixed in a state of covering the first support member 110 and the second support member 120*a*, so that when the second support member 120*a* is moved in the third direction A to press the inside of the clothes so that tension is easily transmitted to the clothes.

As the front side of the clothes is fixed by the fixed first support member 110 and the rear side of the clothes is pressed by the second support member 120*a*, the front side of the clothes may have a tension by the first support member 110 and the rear side of the clothes may have a tension by the second support member 120*a*. Accordingly, clothes may be supported on the support device 100 with the wrinkles removed and tightness maintained overall.

When steam is supplied to the clothes care room 11 by the steam generating device 31 while the second support member 120*a* pressing the inner side of the clothes as described above, the steam is supplied in a state in which tension is transmitted to the clothes by the first support member 110 and the second support member 120*a*, so that wrinkles of clothes may be easily removed.

Referring to FIGS. 6 and 7, the support device 100 may be set into a first state 100A in which the first support member 110 and the second support member 120*a* are arranged adjacent to each other.

When the support device 100 is in the first state 100A, the user may easily cover the top on the support device 100. In this case, the second support member 120*a* is arranged at a first position 120(A) adjacent to the first support member 110, and the fourth support member 116 arranged at the body upper portion 112 may also be arranged at a first position 116(A) adjacent to the body upper portion 112.

As the first support member 110 and the second support member 120*a* are arranged adjacent to each other, and the fourth support member 116 is also arranged adjacent to the first support member 110, the user may easily fix the top to the support device 100 in such a way to put clothes (in particular, a top) on the support device 100.

Referring to FIGS. 8 to 10, after the top is fixed to the support device 100, the second support member 120*a* may be provided to move in the third direction A.

The second support member 120*a* may be moved in the third direction A by the first driving unit 140, and although not shown, the first driving unit 140 may be controlled by a control unit.

The user may close the door 20 and input a start signal for starting a wrinkle removal process to an input unit (not shown), and the control unit (not shown) receiving the signal may drive the first driving unit 140.

The first driving unit 140 may be controlled such that the second support member 120*a* is moved in the third direction A to generate a tension of a predetermined size on the top.

Although not shown, the clothes care apparatus 1 may include a sensor (not shown) capable of measuring the tension generated on the top.

The sensor (not shown) may transmit the measurement value of the tension delivered to the clothes to the control unit (not shown), and the control unit (not shown) may control the first driving unit 140 by calculating a distance moved by the second support member 120*a* in the direction A based on the measurement value of the sensor (not shown).

When the measurement value of the sensor (not shown) reaches a predetermined value, the control unit (not shown) may stop the first driving unit 140 from moving the second support member 120*a* in the third direction A.

Thereafter, the control unit (not shown) may control the steam generating device 31 and the supply fan unit 32 so that steam is supplied into the clothes care room 11.

In detail, the control unit (not shown) may control the first driving unit 140 to drive the drive motor 145 of the first driving unit 140 so that the second support member 120*a* moves in the third direction A along the rail 144.

The drive motor 145 arranged inside the frame 101 may rotate the shaft 142 connected to the drive motor 145 while rotating in one direction or the opposite direction.

The shaft 142 may be provided to correspond to the rotation axis of the drive motor 145 and may rotate in one direction or the opposite direction by the drive motor 145.

The driving body 141 may be provided to be coupled to the shaft 142. In detail, the shaft 142 and the driving body 141 may be coupled to each other through spiral. Accordingly, when the shaft 142 is rotated in one direction, the driving body 141 may advance in the first direction X through a spiral, and when the shaft 142 is rotated in the opposite direction, the driving body 141 may retract in the direction opposite to the first direction X through spiral.

That is, the driving body 141 may be translated in the first direction X through rotation in one direction or the opposite direction of the drive motor 145.

The driving body 141 may include the slit 143 into which the protrusion 122 of the second support member 120*a* is inserted.

The protrusion 122 may be provided in a shape protruding upward from the guide 121 of the second support member 120*a*.

When the driving body 141 is moved in the first direction X, the protrusion 122 inserted into the slit 143 may be pressed in the first direction X in linkage with movement of the driving body 141 in the first direction X.

By the force transmitted to the protrusion 122, the guide 121 of the second support member 120*a* may be pressed in the first direction X, which is a direction in which the protrusion 122 is pressed, and the guide 121 may be moved in the third direction A along the rail 144 extending in the third direction A that is diagonal with respect to the first direction X.

That is, the second support member 120*a* may be moved in the third direction A according to the movement of the driving body 141 in the first direction X by the first driving unit 140.

As the second support member 120*a* is moved in the third direction A, the second support member 120*a* is separated from the fixed first support member 110, which causes the inside of the top to be pressed in the first direction X.

As the second support member 120*a* is spaced apart from the first support member 110 while being moved in the third direction A, the support device 100 may be set into a second state 100B to press the inside of the top.

When the support device 100 is in the second state 100B, the second support member 120*a* may be moved in the third direction A with respect to the first support member 110. In detail, the second support member 120*a* may be moved in the third direction A to a second position 120(B) such that a predetermined tension is transmitted to the inside of the top.

Figure 18:
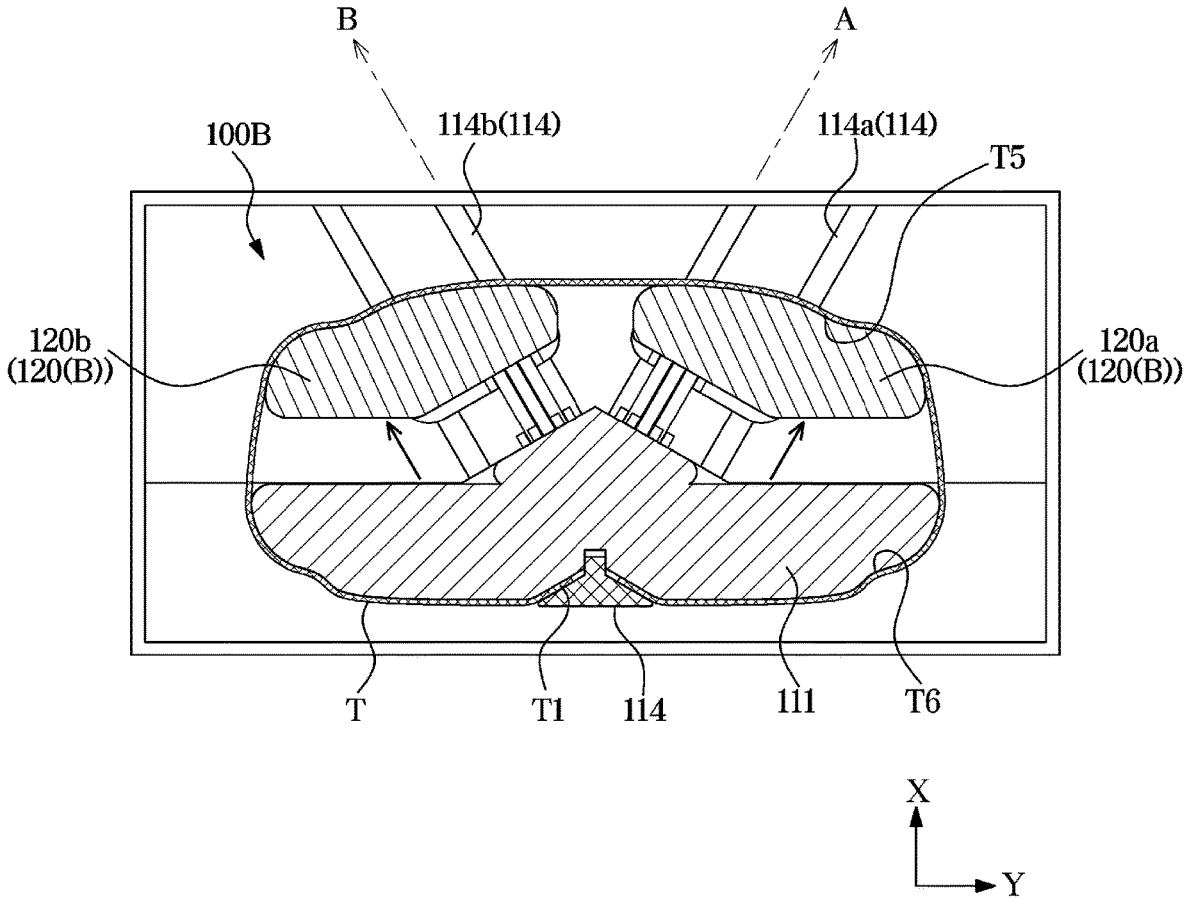
FIG. 18 is a view illustrating a state in which the second support member is moved in a fourth direction, based on the state of FIG. 17.

The inner side of the top is pressed toward the third direction A by the second support member 120*a*, thereby tension is transmitted to the top so that the top may be supported by the support device 100 in a tight state (see FIG. 18).

In addition, when the support device 100 is in the second state 100B, the fourth support member 116 may be moved in the first direction X with respect to the first support member 110. In detail, the fourth support member 116 may be moved in the first direction X to a second position 116(B) such that a predetermined tension is transmitted to an inner side of an upper side or collar side of the top.

That is, when the support device 100 is in the second state 100B, the second support member 120*a* and the fourth support member 116 are spaced apart from the fixed first support member 110 by a distance such that a predetermined tension is applied to the clothes.

As described above, when the support device 100 is in the second state 100B, the control unit (not shown) may control the steam generating device 31 to supply steam in a state in which the tension on the top is maintained.

Steam may be generated for a predetermined period of time so that wrinkles of the top may be removed. After the predetermined time, the control unit (not shown) may end the operation of the steam generating device 31 and control the heater 33 and the supply fan unit 32 to operate the heater 33 and supply hot and dry air into the clothes care room 11.

Thereafter, the control unit (not shown) may operate the suction fan unit 34 to remove the humid air inside the clothes care room 11, and end the wrinkle removal process of the clothes care apparatus 1.

When the wrinkle removal process of the clothes care apparatus 1 ends, the control unit (not shown) may control the first driving unit 140 to move the second support member 120*a* to the first position 120(A) such that the support device 100 returns to the first state 100A.

In addition, the control unit (not shown) may control the fourth support member 116 to return to the first position 116(A).

Conversely, when the second support member 120*a* is moved from the second position 120(B) to the first position 120(A), the drive motor 145 may be rotated in the opposite direction.

As the drive motor 145 is rotated in the opposite direction, the shaft 142 is rotated in the opposite direction in linkage with the drive motor 145, and thus the driving body 141 may be moved in the opposite direction of the first direction X.

According to the movement of the driving body 141 in the opposite direction of the first direction X, the second support member 120*a* is moved in the opposite direction of the third direction A and returns the first position 120(A).

As described above, the first driving unit 140 may be controlled by the control unit (not shown) to move the second support member 120*a*, but the disclosure is not limited thereto. For example, the user may directly drive the first driving unit 140 manually.

That is, without including a sensor (not shown), the user may adjust the first driving unit 140 such that the first driving unit 140 is directly driven to move the second support member 120*a* in the third direction A by a predetermined distance.

That is, the user may directly control the drive motor 145 by inputting a signal to the input unit (not shown) such that the drive motor 145 rotates in one direction or the opposite direction.

In addition, the fourth support member 116 may be controlled by the control unit (not shown) to be translated in the first direction X, but the disclosure is not limited thereto. For example, the user may manually press the fourth support member 116 in the first direction X or in the opposite direction of the first direction X to move the fourth support member 116.

The second support member 120*a* is not simply moved in the first direction X or the second direction Y perpendicular to the first direction X, but is moved in the third direction A and the fourth direction B , which is line symmetry to the third direction A, of two-dimension.

Such a configuration allows the second support member 120*a* to transmit a tension to the top in a direction corresponding to a direction of a tension received when the top is put on the upper body of the human body.

Accordingly, when a clothes care process is performed in a state in which a top is supported on the support device 100, the top may not be deformed or damaged by the tension applied by the support device 100, and wrinkles that may be formed when the top is put on the human body may be effectively removed.

In other words, a first separation distance dl formed between the first support member 110 and each of the second support member 120*a* and the third support member 120*b* in the first direction X may be provided to be variable.

In addition, a second separation distance d2 formed between the second support member 120*a* and the third support member 120*b* in the second direction Y may be provided to be variable.

In detail, the first separation distance d1 and the second separation distance d2 may have minimum values when the support device 100 is in the first state 100A, and may have maximum values d1' and d2', respectively, when the support device 100 is in the second state 100B.

That is, the first separation distance d1 and the second separation distance d2 may be provided to be variable.

As the second support member 120*a* and the third support member 120*b* are moved in the third direction A and the fourth direction B, respectively, with respect to the first support member 110, the first separation distance d1 and the second separation distance d2 may be variable.

Although not shown in the drawings, the first support member 110 may move in the first direction X and the opposite directions of the first direction X with respect to the second support member 120*a* and the third support member 120*b*.

Accordingly, the first separation distance d1 and the second separation distance d2 may be provided to be variable through the movement of the first support member 110.

As the first separation distance d1 and the second separation distance d2 are provided to be variable, tension is transmitted to the top so that wrinkles may be efficiently removed.

Hereinafter, a feature in which the top is fixed to the support device 100 and the sleeve fixing portion 40 will be described in detail.

Figure 11:
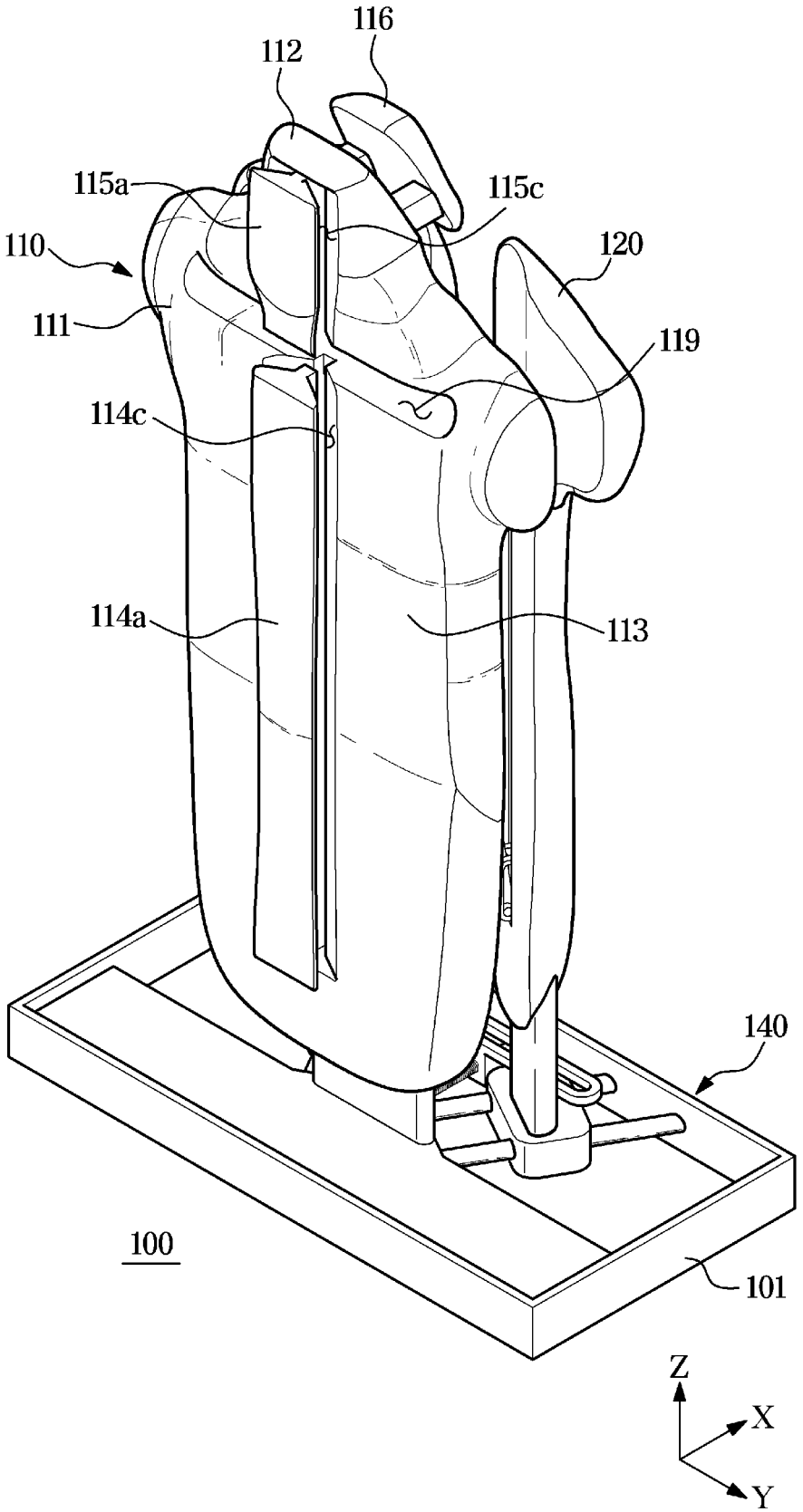
FIG. 11 is a view illustrating a state in which a fixing portion of the support device according to the embodiment of the disclosure is moved.
Figure 12:
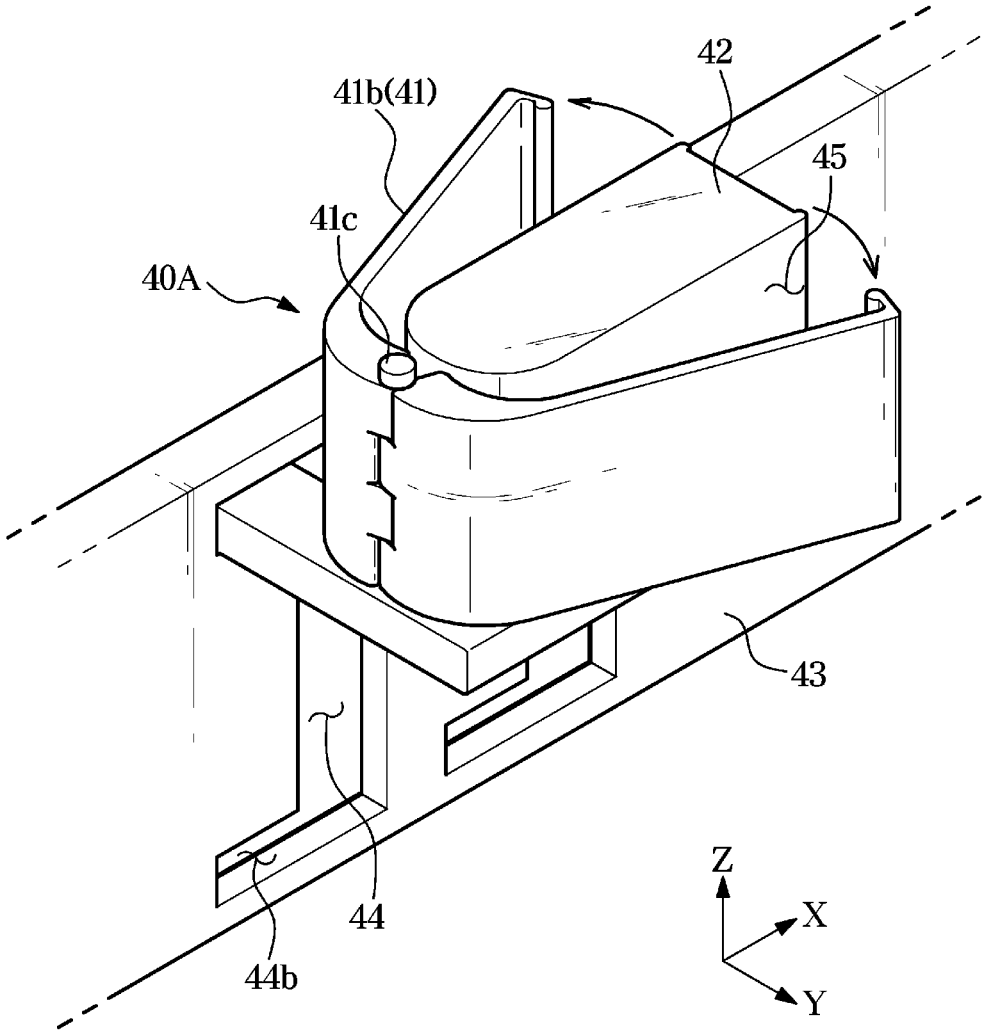
FIG. 12 is a view illustrating a state in which a sleeve fixture of a sleeve fixing portion of the clothes care apparatus according to the embodiment of the disclosure is separated.
Figure 13:
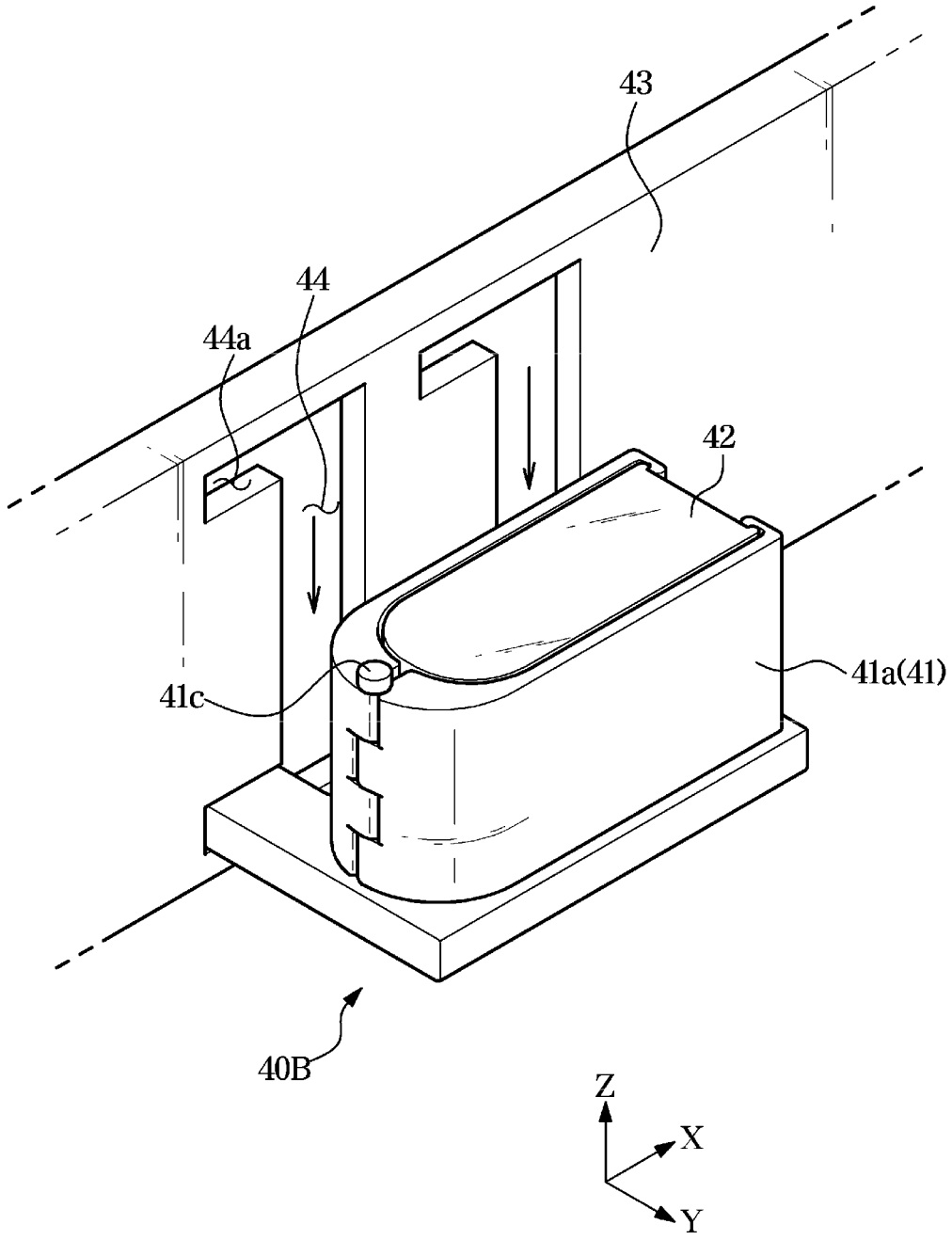
FIG. 13 is a view illustrating a state in which the sleeve fixing portion of the clothes care apparatus according to the embodiment of the disclosure is moved downward.

FIG. 11 is a view illustrating a state in which a fixing portion of the support device according to the embodiment of the disclosure is moved, FIG. 12 is a view illustrating a state in which a sleeve fixture of the sleeve fixing portion of the clothes care apparatus according to the embodiment of the disclosure is separated, and FIG. 13 is a view illustrating a state in which the sleeve fixing portion of the clothes care apparatus according to the embodiment of the disclosure is moved downward.

As described above, in the case of a top with an open front portion, such as a shirt, the top may not be fixed to the support device 100 by simply covering the top on the support device 100.

In this case, as shown in FIG. 11, the first support member 110 may include a fixing portion to fix a shirt-like top to the support device 100.

The fixing portion may include the first fixing portion 114 provided to fix a front portion of the top and the second fixing portion 115 provided to fix a collar side of the top.

The first fixing member 114 may a first fixture 114*a* and a first elastic member 114*b* elastically supporting the first fixture 114*a* in the first direction X such that the first fixture 114*a* is biased in the first direction X (See FIG. 7).

The first fixing portion 114 may be formed on the flat portion 113 of the body 111.

The first fixing portion 114 may be provided in a shape inserted into a groove formed in the flat portion 113 of the body 111.

The user presses the first fixture 114*a* in a direction opposite to the first direction X such that the first fixture 114*a* is separated from the groove of the flat portion 113 in the opposite direction of the first direction X.

However, since the first fixture 114*a* is biased by the first elastic member 114*b* as described above, when the pressure of the user ends, the first fixture 114*a* is moved in the first direction X to be inserted into the groove of the flat portion 113.

When the user presses the first fixture 114*a* in the opposite direction of the first direction X, a first separation 114*c* may be formed between the first fixture 114*a* and the groove of the flat portion 113.

The user may insert the front portion of the top into the first separation 114*c* formed when the first fixture 114*a* is pressed in the opposite direction of the first direction X, and stop pressing the first fixture 114*a*.

In this case, the front portion of the top is arranged between the first fixture 114*a* and the groove of the flat portion 113 and is fixed between the first fixture 114*a* and the groove of the flat portion 113 by the pressing of the first fixture 114*a* in the first direction X that is caused by the first elastic member 114*b*.

As described above, the front portion of the top is fixed by the first fixing portion 114 so that the top may be stably supported by the support device 100.

The front surface of the first fixture 114*a* and the flat portion 113 may be provided to be arranged on the same plane.

That is, when the first fixture 114*a* is biased in the first direction X, the front surface of the first fixture 114*a* and the flat portion 113 may be provided to be arranged on the same plane.

Such a configuration allows wrinkles of a bottom to be removed when the bottom is inserted into the support groove 119 and supported by the first support member 110, which will be described below in detail.

In a similar form as that of the first fixing portion 114, the second fixing portion 115 may fix the collar side of the top.

Although not shown, the second fixing portion 115 may include a second fixture 115*a* and a second elastic member (not shown) that biases the second fixture 115*a* in the first direction X.

When the user presses the second fixture 115*a* in the opposite direction of the first direction X, a second separation 115*c* may be generated between the second fixture 115*a* and a groove of the body upper portion 112.

The user may insert the collar side into the second separation 115*c* formed when the second fixture 115*a* is pressed in the opposite direction of the first direction X, and stop pressing the second fixture 115*a*.

In this case, the collar side of the top may be arranged between the second fixture 115*a* and the groove of the body upper portion 112, and may be fixed between the second fixture 115*a* and the groove of the body upper portion 112 by the pressing of the second fixture 115*a* in the first direction X caused by the second elastic member (not shown).

In a state in which the collar side is fixed to the second fixing portion 115, the fourth support member 116 is moved in the first direction X to press the inner side of the collar side so that wrinkles on the collar side may be easily removed.

Wrinkles of the top may be removed overall through the first support member 110 and the second support member 120*a*, but in the case of a long-sleeve type top, wrinkles between a sleeve side and a shoulder side of the clothes may not be removed through the first support member 110 and the second support member 120*a*.

Accordingly, in order to remove the wrinkles between the sleeve side and the shoulder side of the clothes, the clothes care apparatus 1 according to the embodiment of the disclosure may include the sleeve fixing portion 40 provided to fix the sleeve side of the clothes and transmit tension to an area between the sleeve side and the shoulder side as shown in FIGS. 12 and 13.

The main body 10 may include the sleeve fixing portion 40. In detail, the sleeve fixing portions 40 may be arranged on inner surfaces of the opposite sides 12 of the main body 10 (see FIG. 4).

The sleeve fixing portions 40 may be arranged in a pair so that each sleeve side of the clothes may be fixed to a corresponding one of the sleeve fixing portions 40. Since the pair of sleeve fixing portions 40 are provided in the same form, only one of the pair of sleeve fixing portions 40 will be described for the sake of convenience in description.

The sleeve fixing portion 40 may be provided to be translated in the fifth direction Z perpendicular to the first direction X and the second direction Y inside the main body 10. That is, the sleeve fixing portion 40 may be moved in the upper and lower side direction with respect to the main body 10.

The sleeve fixing portion 40 may include a central body 42 and a sleeve fixture 41 provided to be separable from the central body 42.

The sleeve fixing portion 40 may include a fixing plate 43 that is provided to support the central body 42 while supporting the sleeve fixing portion 40 on the side 12 of the main body 10.

The fixing plate 43 may be provided to be coupled to the side 12 of the main body 10 so that the sleeve fixing portion 40 is supported on the side 12 of the main body 10.

The sleeve fixing portion 40 may include a guide rail 44 provided on the fixing plate 43 and guiding the central body 42 to move in the upper and lower side direction.

The central body 42 and the sleeve fixture 41 coupled to the central body 42 may be translated in the fifth direction Z along the guide rail 44.

As described above, the sleeve fixture 41 may be provided to be separable from the central body 42.

When the position of the sleeve fixture 41 at which the sleeve fixture 41 is coupled to the central body 42 is referred to as a first position 41*a*, and the position of the sleeve fixture 41 at which the sleeve fixture 41 is disposed apart from the central body 42 is referred to as a second position 41*b*, in a case when the sleeve fixture 41 is arranged in the second position 41*b*, a third separation 45 is formed between the sleeve fixture 41 and the central body 42. In this case, the user may place the sleeve side into the third separation 45, so that the sleeve side may be fixed to the sleeve fixing portion 40.

The sleeve fixture 41 may be hooked to the central body 42. A hinge shaft 41*c* is formed on the center side of the sleeve fixture 41 so that one end of the sleeve fixture 41 is extended by a predetermined length.

When one end of the sleeve fixture 41 is extended by the predetermined length, the sleeve fixture 41 may be separated from the central body 42 to form the third separation 45, and the sleeve side is placed on the third separation 45 and then the sleeve fixture 41 is coupled to the central body 42, so that the sleeve side may be fixed between the sleeve fixture 41 and the central body 42.

Although not shown, the hinge shaft 41*c* includes an elastic member such that both ends of the sleeve fixture 41 are biased toward the central body 42.

Accordingly, when the sleeve side is disposed between the sleeve fixture 41 and the central body 42, the sleeve side may be stably fixed to the sleeve fixing portion 40 by the biasing force of the sleeve fixture 41.

When the sleeve fixture 41 and the central body 42 are arranged at the upper end of the guide rail 44, the sleeve fixing portion 40 is referred to as being in a first position 40A, and the sleeve side may be preferably fixed to the sleeve fixing portion 40 when the sleeve fixing portion 40 is in the first position 40A.

The sleeve fixing portion 40 may be moved in a direction opposite to the fifth direction Z along the guide rail 44 in a state in which the sleeve side is fixed to the sleeve fixing portion 40. That is, the sleeve fixing portion 40 may be moved downward along the guide rail 44.

When the sleeve fixture 41 and the central body 42 of the sleeve fixing portion 40 are moved along the guide rail 44 and located at the lower end of the guide rail 44, the sleeve fixing portion 40 is referred to as being in a second position 40B.

In this case, since the sleeve side is moved downward together with the sleeve fixture 41 and the central body 42, tension may be transmitted to an area from the sleeve side to the shoulder side of the top.

The guide rail 44 may be provided in a groove shape vertically extending in the fixing plate 43 and may include an upper end portion 44*a* and a lower end portion 44*b* extending laterally at the upper end and the lower end, respectively.

When the central body 42 is mounted on the upper end portion 44*a*, the sleeve fixing portion 40 may be arranged in the first position 40A, and when the central body 42 is mounted on the lower end portion 44*b*, the sleeve fixing portion 40 may be arranged in the second position 40B.

The user may manually press the central body 42 to move the sleeve fixing portion 40 to the first position 40A or the second position 40B. However, the disclosure is not limited thereto, and the control unit (not shown) may control the sleeve fixing portion 40 such that the sleeve fixing portion 40 is translated in the fifth direction Z by the control unit (not shown).

Accordingly, wrinkles on the overall area of the top may be removed by the first support member 110 and the second support member 120*a*, and wrinkles in a position where wrinkle removal is complicated , such as a collar side and a sleeve side of the top, are also easily removed by the fourth support member 116 and the sleeve fixing portion 40.

Hereinafter, a technical feature in which a top with an open front portion, such as a shirt, is fixed to the support device 100 and tension is provided to the top will be described in sequence.

Figure 14:
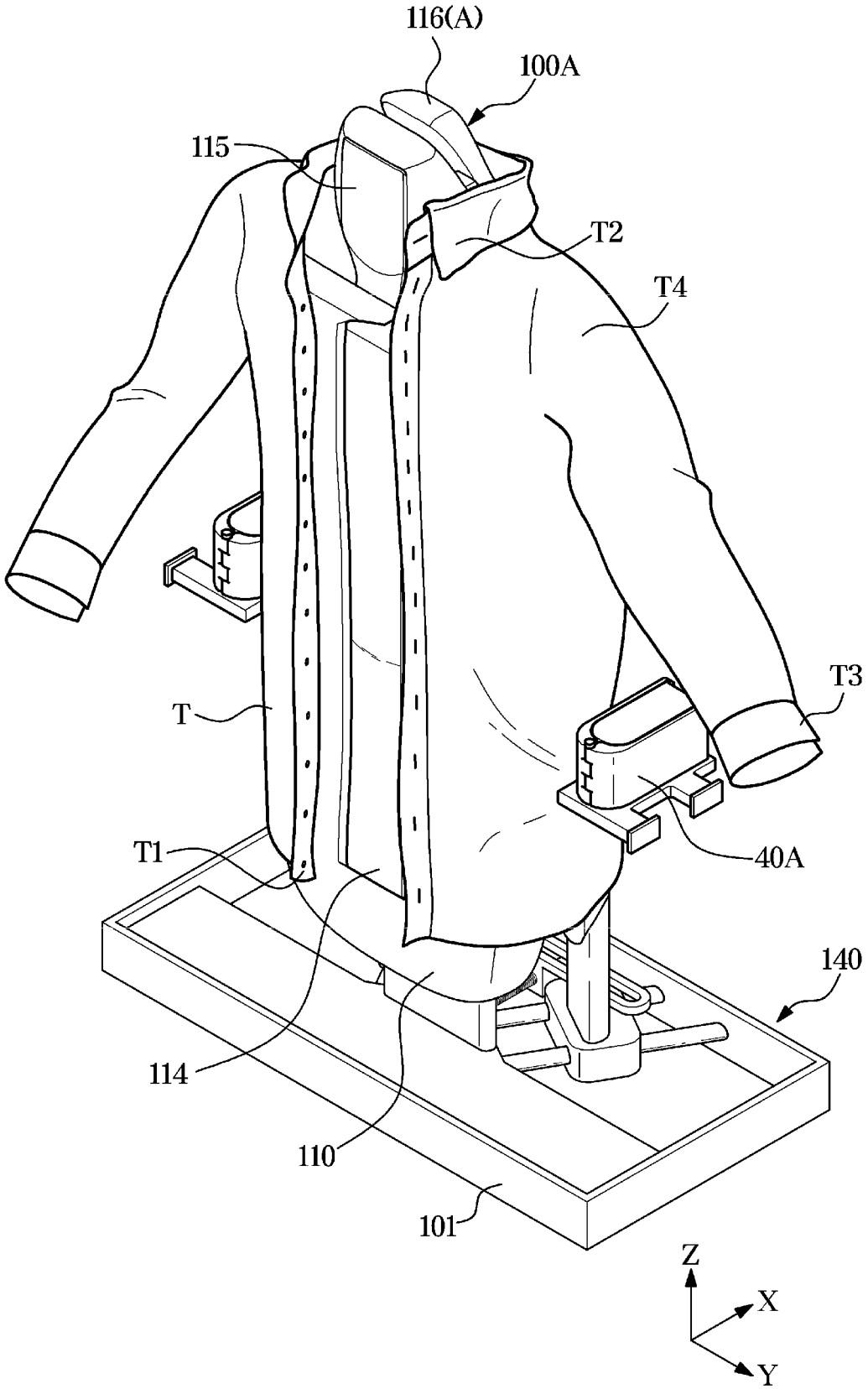
FIG. 14 is a view illustrating a state in which a top is mounted on the support device of the clothes care apparatus according to the embodiment of the disclosure.
Figure 15:
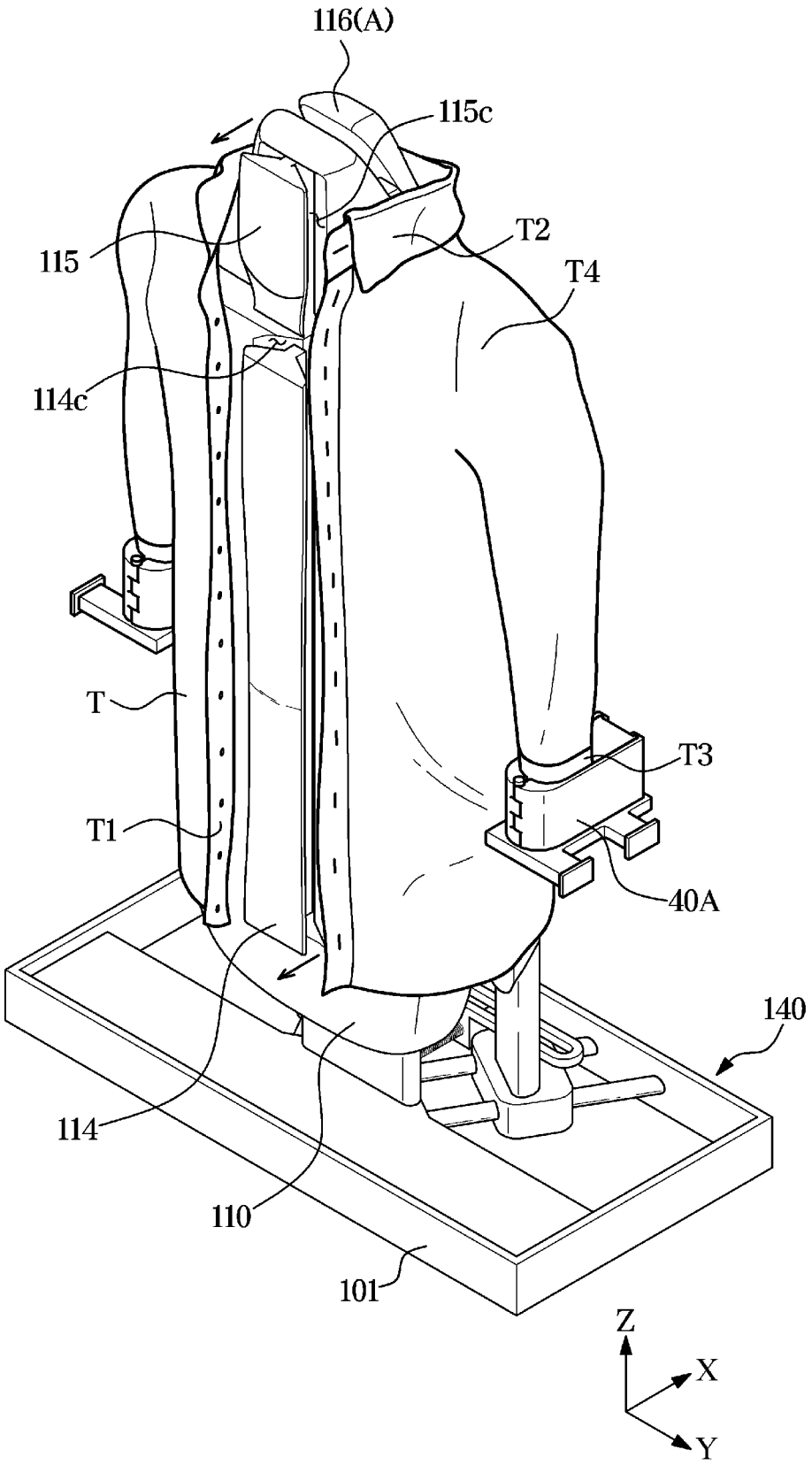
FIG. 15 is a view illustrating a state in which a sleeve of the top is fixed to the sleeve fixing portion, based on the state of FIG. 14.
Figure 16:
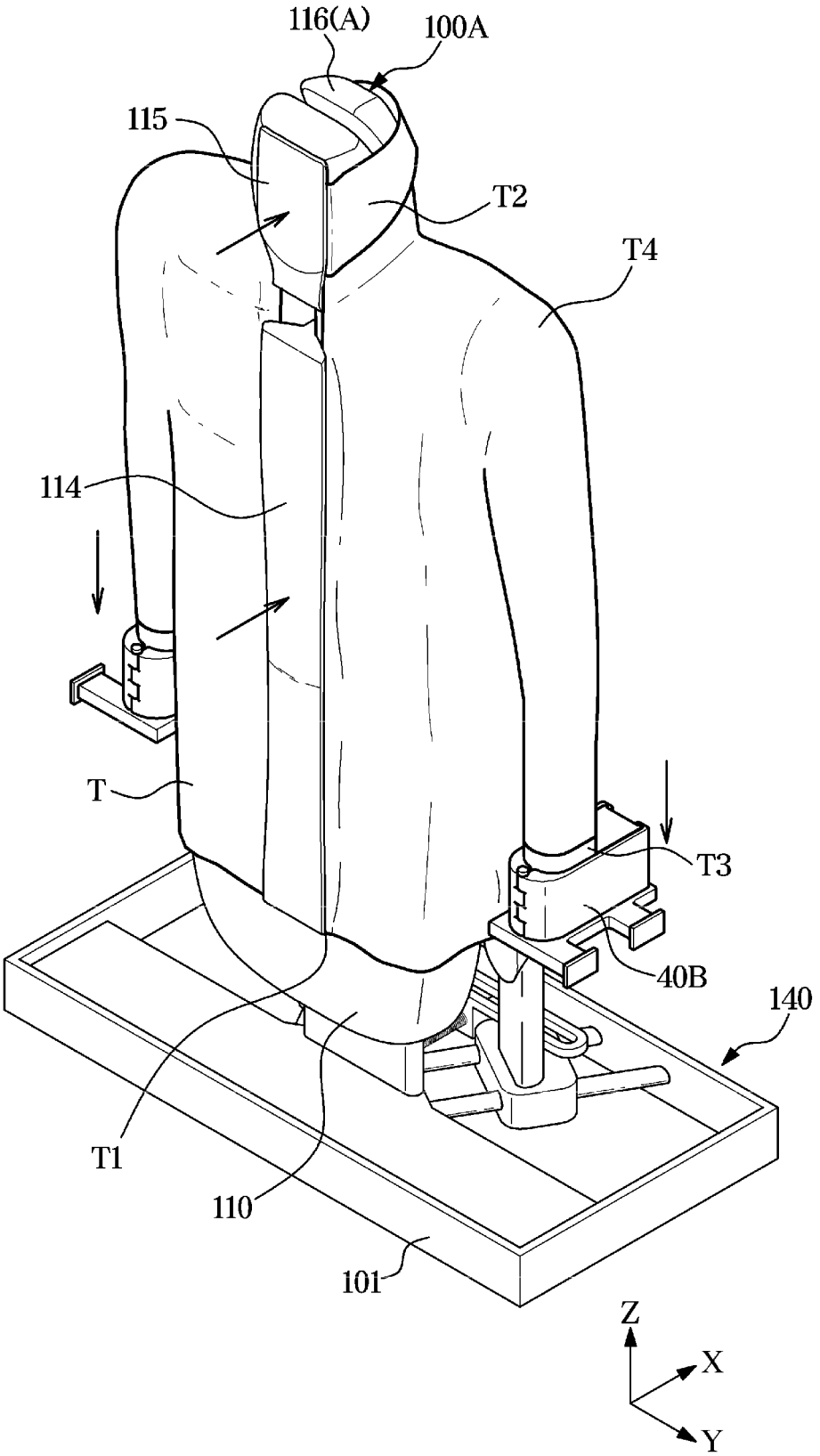
FIG. 16 is a view illustrating a state in which the sleeve fixing portion is moved downward and a top is fixed to the fixing portion, based on the state of FIG. 15.
Figure 17:
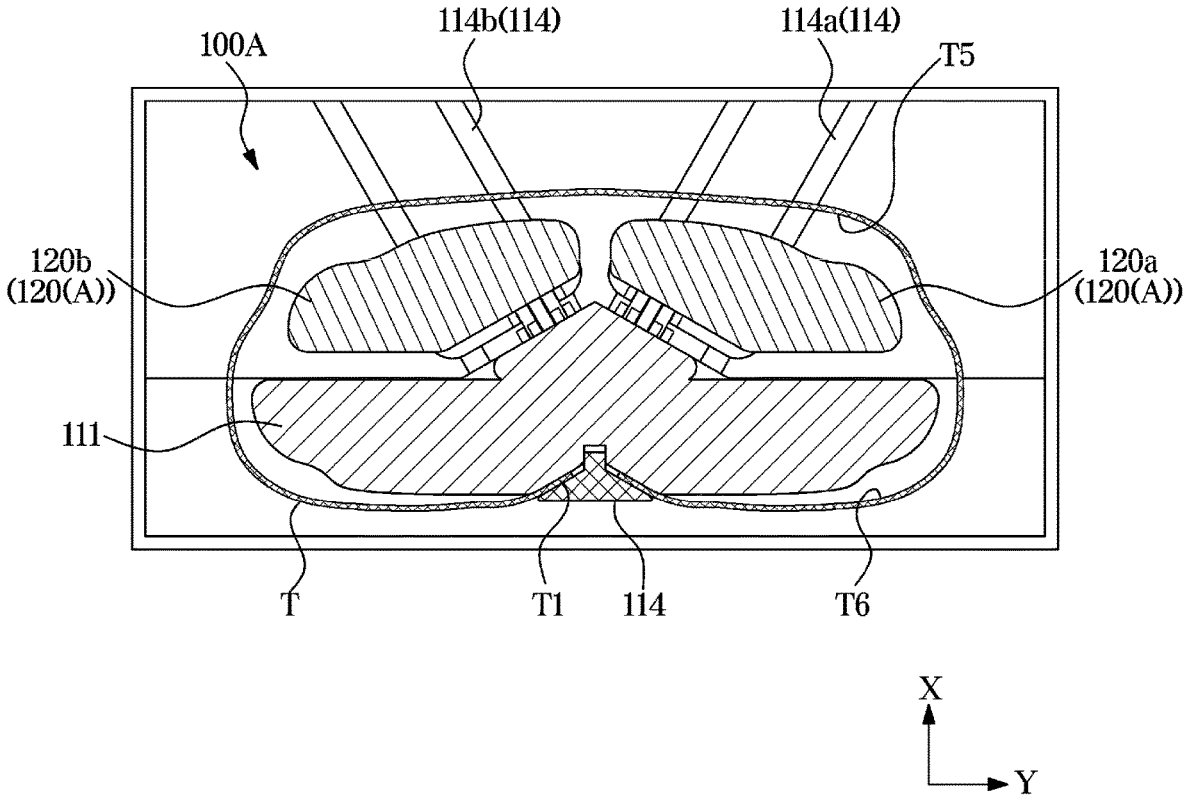
FIG. 17 is a cross-sectional view illustrating a state in which a top is fixed to the support device shown in FIG. 16.

FIG. 14 is a view illustrating a state in which a top is mounted on the support device of the clothes care apparatus according to the embodiment of the disclosure, FIG. 15 is a view illustrating a state in which a sleeve of the top is fixed to the sleeve fixing portion, based on the state of FIG. 14, FIG. 16 is a view illustrating a state in which the sleeve fixing portion is moved downward and a top is fixed to the fixing portion, based on the state of FIG. 15, FIG. 17 is a cross-sectional view illustrating a state in which a top is fixed to the support device shown in FIG. 16, and FIG. 18 is a view illustrating a state in which the second support member is moved in a fourth direction, based on the state of FIG. 17.

Referring to FIG. 14, a top T may be put on the support device 100 in the first state 100A. However, as for a shirt-type top T, a front portion T1 of the top T may remain open without being fixed to the support device 100, and thus may be separated from the support device 100.

In addition, a collar side T2 and a sleeve side T3 of the top T are also not supported by the support device 100.

Accordingly, referring to FIG. 15, the user presses the first fixing portion 114 and the second fixing portion 115 in the opposite direction of the first direction X to form the first separation 114*c* and the second separation 115*c* to fix the top T to the first support member 110.

The user may insert the front portion T1 of the top T into the first separation 114*c* and the collar side T2 of the top T into the second separation 115*c*.

In addition, the user may insert a sleeve side T3 into the sleeve fixing portion 40 and fix the sleeve side T3 to the sleeve fixing portion 40. In this case, the sleeve side T3 may be provided to be fixed to the sleeve fixing portion 40 in a state in which the sleeve fixing portion 40 is arranged in the first position 40A.

Thereafter, referring to FIG. 16, the user may end the pressing of the first fixing portion 114 and the second fixing portion 115 in the opposite direction of the first direction X. When the pressing of the first fixing portion 114 and the second fixing portion 115 in the opposite direction of the first direction X ends, the first fixing portion 114 and the second fixing portion 115 are biased in the firs direction X, so that the front portion T1 and the collar side T2 may be fixed to the first fixing portion 14 and the second fixing portion 115, respectively.

In addition, the user may move the sleeve fixing portion 40 from the first position 40A to the second position 40B. As the sleeve side T3 is moved in the opposite direction of the fifth direction Z together with the sleeve fixing portion 40, tension may be transmitted to the area from the sleeve side T3 to the shoulder side T4 by the sleeve fixing portion 40.

However, the disclosure is not limited to FIGS. 15 and 16, and the user first may fix the front portion T1 and the collar side T2 to the first fixing portion 114 and the second fixing portion 115 before fixing the sleeve side T3 to the sleeve fixing portion 40. The order thereof is not limited.

Referring to FIG. 17, the cross-sectional area of the top T is larger than that of the support device 100 when viewed on the cross-section of the top T fixed to the support device 100 in the first state 100A. In this case, the top T may not receive tension from the support device 100, so that wrinkles may not be removed.

However, referring to FIG. 18, when the top T is fixed to the support device 100 and the second support member 120*a* is moved to the second position 120(B) so that the support device 100 is set into the second state 100B, the top T may be tensioned by the first support member 110 and the second support member 120*a*.

That is, as the second support member 120*a* is moved from the first position 120(A) to the second position 120(B), a rear inner surface T5 of the top T is pressed by the second support member 120*a*, and a front inner surface T6 of the top T is pressed by the fixed first support member 110, so that tension is transmitted to the top T and wrinkles of the top T are efficiently removed.

In addition, although not shown in the drawings, when the inside of the collar side T2 is pressed in the first direction X by the fourth support member 116 in a state in which a front end of the collar side T2 is fixed to the second fixing portion 115, tension is transmitted to the collar side T2 and wrinkles of the collar side T2 are effectively removed.

Hereinafter, a technical feature in which wrinkles on a bottom are removed by the support device 100 will be described in detail.

Figure 19:
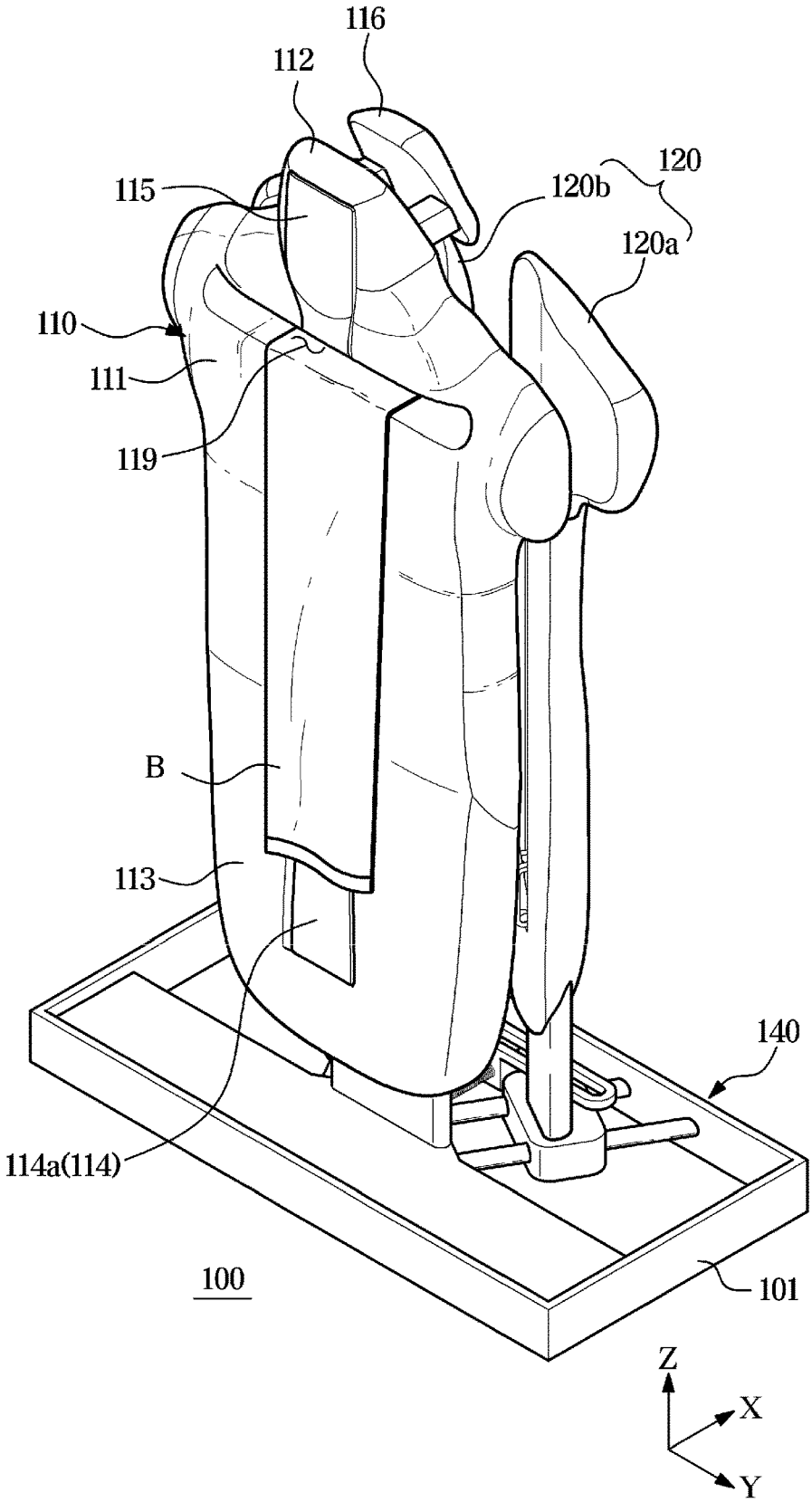
FIG. 19 is a view illustrating a state in which a bottom is supported on the support device according to the embodiment of the disclosure.
Figure 20:
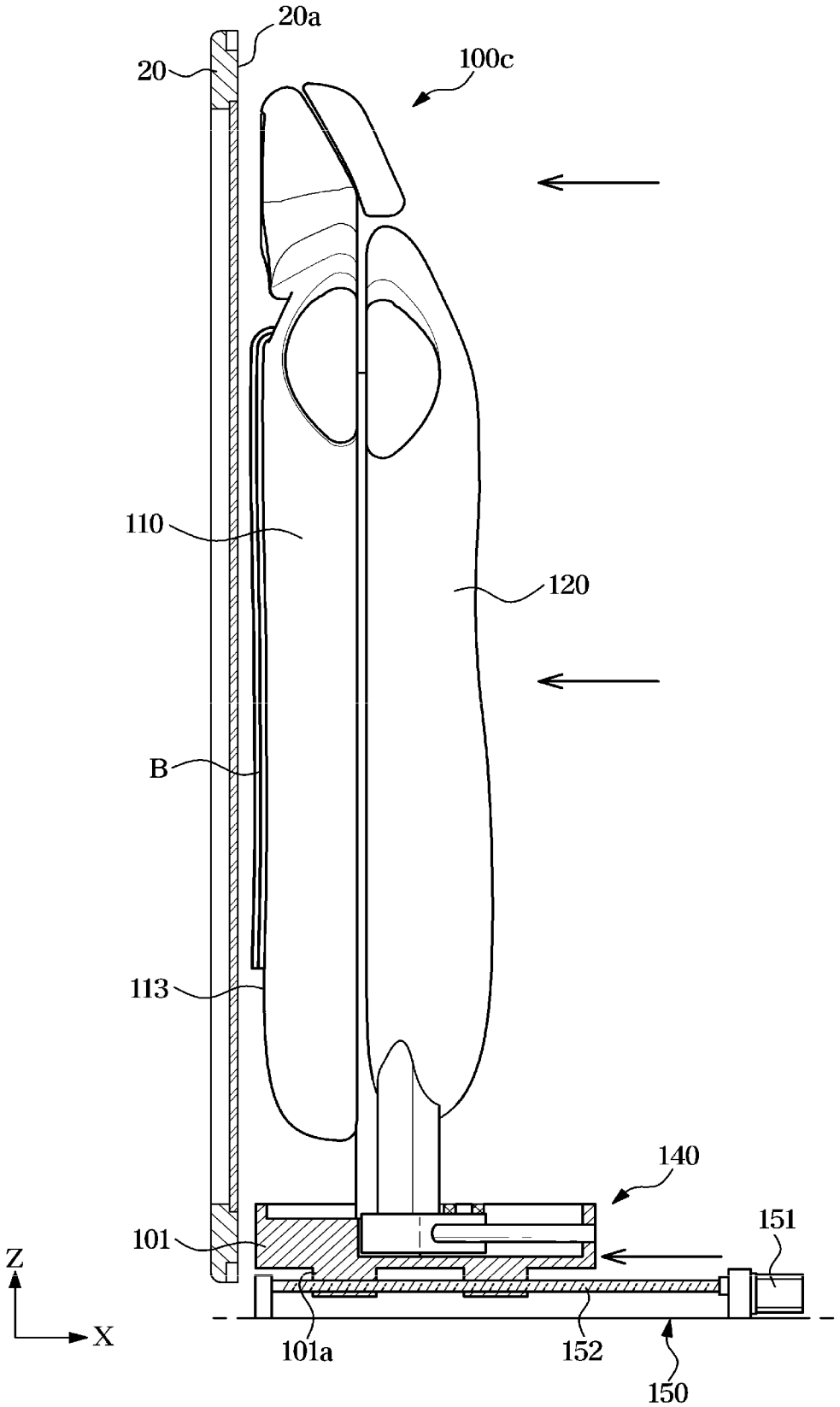
FIG. 20 is a view illustrating a state in which the support device shown in FIG. 19 is being moved forward.

FIG. 19 is a view illustrating a state in which a bottom is supported on the support device according to the embodiment of the disclosure, and FIG. 20 is a view illustrating a state in which the support device shown in FIG. 19 is being moved forward.

The conventional clothes care apparatus for removes wrinkles may remove wrinkles of a top, but have difficulty in removing wrinkles of a bottom due to being incapable of supporting the bottom by itself.

However, the support device 100 of the clothes care apparatus 1 according to the embodiment of the disclosure may easily remove the wrinkles of a bottom B by supporting the bottom B in addition to the top T.

Referring to FIG. 19, the bottom B may be supported by the first support member 110 through the support groove 119 formed in the first support member 110.

In detail, as at least a part of an upper portion of the bottom B is inserted into the support groove 119, the bottom B may be supported by the support groove 119.

The support groove 119 may be provided on the upper side of the flat portion 113. Accordingly, a lower portion of the bottom B supported by the support groove 119 may be arranged to come in contact with the flat portion 113.

In addition, the first fixing portion 114 may be arranged on the flat portion 113. As described above, the front surface of the first fixture 114*a* of the first fixing portion 114 may be arranged on the same plane on which the flat portion 113 is arranged. Therefore, the lower portion of the bottom B may be arranged in contact with one plane.

In this case, the support device 100 may be moved in the opposite direction of the first direction X by a second driving unit 150 within the main body 10.

That is, the support device 100 may include the second driving unit 150 that drives the support device 100 such that the entire support device 100 is translated in the first direction X.

The second driving unit 150 is arranged at a lower side of the frame 101 to move the frame 101 in the first direction X or in the opposite direction of the first direction X.

The second driving unit 150 may include an auxiliary drive motor 151 and an auxiliary shaft 152 connected to the auxiliary drive motor 151.

The frame 101 may include a frame guide 101*a* spirally coupled to the auxiliary shaft 152 to guide the frame 101 in the first direction X or the opposite direction of the first direction X according to the rotation of the auxiliary shaft 152.

When the auxiliary drive motor 151 is rotated in one direction, the frame 101 may be moved in the opposite direction of the first direction X in linkage with the rotation of the auxiliary drive motor 151. Accordingly, the lower portion of the bottom B mounted on the flat portion 113 may come in contact with a rear surface 20*a* of the door 20.

The door 20 has a configuration formed in a flat surface, and the rear surface 20*a* of the door 20 may also be formed in a flat surface. The rear surface 20*a* of the door 20 may be formed parallel to the flat portion 113.

As the auxiliary drive motor 151 rotates, the support device 100 gradually moves closer to the rear surface 20*a* of the door 20 until the rear surface 20*a* of the door 200 comes into contact with the flat portion 113.

Accordingly, the lower portion of the bottom B is arranged between the rear surface 20*a* of the door 20 and the flat portion 113, and when the flat portion 113 is pressed in the opposite direction of the first direction X, wrinkles of the bottom B may be removed by the flat portion 113 and the rear surface 20*a* of the door 20.

Hereinafter, a clothes care apparatus 1 according to another embodiment of the disclosure will be described. Since the configurations except for a press plate 60 described below are the same as those of the clothes care apparatus 1 according to the embodiment of the disclosure described above, the description thereof will be omitted.

Figure 21:
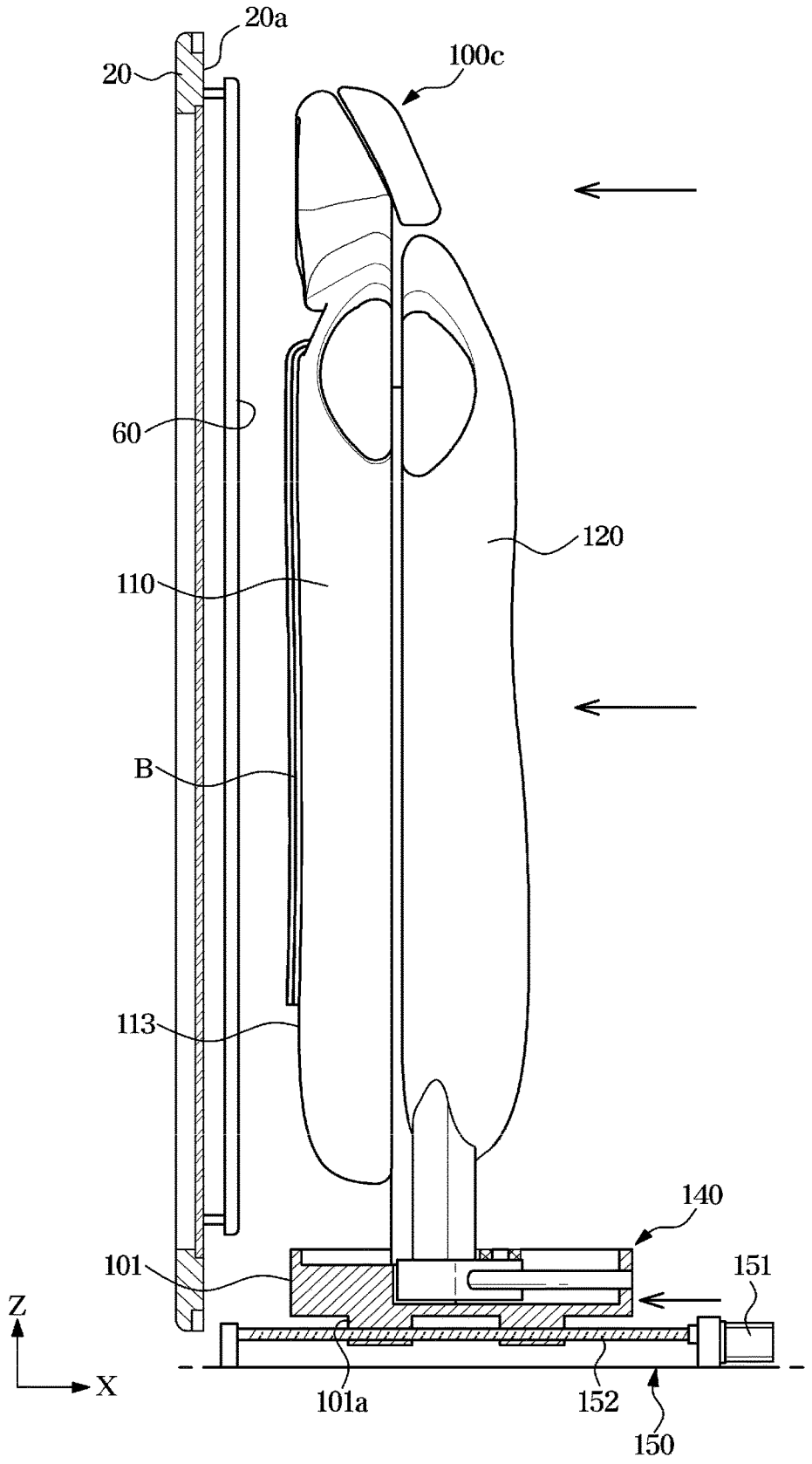
FIG. 21 is a view illustrating a state in which a support device of a clothes care apparatus according to another embodiment of the disclosure is being moved forward.

Referring to FIG. 21, the main body 10 may include the press plate 60 that is provided to come in contact with the flat portion 113 of the first support member 110 when the support device 100 is moved in the opposite direction of the first direction X.

The press plate 60 may be arranged on the rear surface 20*a* of the door 20.

The press plate 60 may be arranged at a position corresponding to that of the flat portion 113.

When the support device 100 is moved in the opposite direction of the first direction X by the second driving unit 150, the flat portion 113 is moved in the direction of the press plate 60 and makes approximately surface contact with the press plate 60.

Therefore, when the bottom B is mounted on the flat portion 113, wrinkles of the bottom B may be removed by the press plate 60 and the flat portion 113.

In addition, a hot wire (not shown) may be arranged inside the press plate 60. The press plate 60 may include a steel material. Accordingly, heat generated in the heating wire (not shown) is conducted to the press plate 60 and increases the temperature of the press plate 60, thereby further effectively removing the wrinkles of the bottom B.

As is apparent from the above, the clothes care apparatus can easily transfer a physical force required for wrinkle removal without clothes being folded or covered, and effectively remove wrinkles of the clothes by spraying steam to the entire clothes to provide required moisture.

Although few embodiments of the disclosure have been shown and described, the above embodiment is illustrative purpose only, and it would be appreciated by those skilled in the art that changes and modifications may be made in these embodiments without departing from the principles and scope of the disclosure, the scope of which is defined in the claims and their equivalents.

What is claimed is:

1. A clothes care apparatus comprising:

a main body including a clothes care room;

a support device arranged inside the clothes care room and configured to support clothes; and a steam generating device configured to supply steam into the clothes care room, wherein the support device includes a first support member, and a second support member and a third support member that are arranged in a first direction with respect to the first support member, the first support member and each of the second support member and the third support member are separated by a first separation distance, the second support member and the third support member are separated by a second separation distance in a second direction which is perpendicular to the first direction, wherein each of the first separation distances, and the second separation distance are provided to be variable, and wherein the first support member includes:

a body configured to support a top clothing of the clothes when placed thereon, the body having an upper portion to support a collar of the top clothing thereon; and a fourth support member arranged on a side of the upper portion of the body in the first direction and configured to advance in the first direction and retract in the direction opposite to the first direction.

2. The clothes care apparatus of claim 1, wherein the second support member is configured to advance in a third direction formed between the first direction and the second direction and retract in a direction opposite to the third direction, and the third support member is configured to advance in a fourth direction that is line-symmetry to the third direction about the first direction, and retract in a direction opposite to the fourth direction.

3. The clothes care apparatus of claim 2, wherein in response to the movement of the second support member and the third support member in the third direction and the fourth direction, respectively, the first separation distance and the second separation distance are increased.

4. The clothes care apparatus of claim 1, wherein a first fixing portion arranged on a side of the body in a direction opposite to the first direction such that a front portion of the top clothing is fixed to the body.

5. The clothes care apparatus of claim 4, wherein the first fixing portion includes a first fixture and a first elastic member elastically supporting the first fixture such that the first fixture is biased in the first direction, and the first fixture is provided such that the front portion of the top clothing is fixed between the first fixture and the body.

6. The clothes care apparatus of claim 5, wherein a front surface of the first fixture and a front surface of the body are arranged to be coplanar with each other.

7. The clothes care apparatus of claim 1, wherein the first support member further includes a second fixing portion arranged on a side of the upper portion of the body in the direction opposite to the first direction such that a front portion of the collar of the top clothing is fixed to the upper portion of the body.

8. The clothes care apparatus of claim 1, wherein a front portion of the body includes a flat surface, and the body further includes a support groove arranged at an upper side of the flat surface such that at least a portion of a bottom clothing of the clothes is inserted into the support groove and supported.

9. The clothes care apparatus of claim 8, wherein the support device is configured to advance in the direction opposite to the first direction and retract in the first direction, and is configured to advance in the direction opposite to the first direction such that the flat surface of the body is adjacent to an inner surface of the main body.

10. The clothes care apparatus of claim 9, wherein the main body further includes a press plate that is arranged on the inner surface of the main body and configured to come in contact with the flat surface of the body when the flat surface of the body is moved in a direction toward the inner surface.

11. The clothes care apparatus of claim 1, wherein the main body includes a sleeve fixing portion configured to fix a sleeve of a top clothing of the clothes, wherein the sleeve fixing portion is configured to advance in a fifth direction which is perpendicular to the first direction and the second direction and retract in a direction opposite to the fifth direction inside the main body.

12. The clothes care apparatus of claim 11, wherein the sleeve fixing portion includes a central body and a sleeve fixture provided to be separable from the central body, and the sleeve fixing portion allows the sleeve of the top clothing to be arranged and fixed between the central body and the sleeve fixture.

13. The clothes care apparatus of claim 1, wherein the support device further includes a motor and a driving body connected to the motor and configured to advance in the first direction and retract in a direction opposite to the first direction by a driving of the motor, and the second support member is configured to advance in the third direction and retract in a direction opposite to the third direction, and the third support member is configured to advance in the fourth direction and retract in a direction opposite to the fourth direction in linkage with the driving body.

14. The clothes care apparatus of claim 13, wherein the driving body includes a plurality of rails respectively extending in the third direction and the fourth direction, a slit, each of the second support member and the third support member includes a protrusion inserted into the slit, and the second support member and the third support member, while having the respective protrusions guided by the slits, advancing in the third direction and retracting in the direction opposite to the third direction and advancing in the fourth direction and retracting in the direction opposite to the fourth direction, respectively, along the plurality of rails.

15. A clothes care apparatus comprising:

a main body including a clothes care room;

a support device arranged inside the clothes care room and configured to support clothes; and a steam generating device configured to supply steam into the clothes care room, wherein the support device includes a first support member provided to support a top clothing and a bottom clothing, and a second support member arranged in a first direction with respect to the first support member and to support the top clothing by pressing the top clothing from an inside of the top, the first support member includes a support groove arranged on a side of the first support member in a direction opposite to the first direction and into which the bottom clothing is inserted and supported, and the support device is configured to advance in the direction opposite to the first direction and retract in the first direction.

16. The clothes care apparatus of claim 15, further comprising a third support member arranged in a second direction which is perpendicular to the first direction with respect to the second support member, and the second support member is configured to advance in a third direction between the first direction and the second direction and retract in a direction opposite to the third direction, the third support member is configured to advance in a fourth direction that is line-symmetry to the third direction about the first direction and retract in a direction opposite to the fourth direction.

17. The clothes care apparatus of claim 16, wherein the first support member further includes a fixing portion arranged at a lower side of the support groove and allowing a front portion of the top clothing to be fixed to the first support member.

18. The clothes care apparatus of claim 16, wherein the support device further includes:

a first driving unit configured to transfer a driving force to the second support member and the third support member to move the second support member and the third support member in the third direction and the fourth direction, respectively, and a second driving unit configured to transfer a driving force to the support device to advance the support device in the direction opposite to the first direction and to retract the support device in the first direction.

19. A clothes care apparatus comprising:

a main body including a clothes care room;

a support device arranged inside the clothes care room and configured to support clothes; and a steam generating device configured to supply steam into the clothes care room, wherein the support device includes:

a first support member to support clothes;

a second support member arranged in a first direction with respect to the first support member; and a third support member arranged in a second direction which is perpendicular to the first direction with respect to the second support member, and the second support member is configured to advance in a third direction between the first direction and the second direction and retract in a direction opposite to the third direction, and the third support member is configured to advance in a fourth direction that is line-symmetry to the third direction about the first direction and retract in a direction opposite to the fourth direction, wherein the first support member includes:

a body configured to support a top clothing of the clothes when placed thereon, the body having an upper portion to support a collar of the top clothing thereon; and a fourth support member arranged on a side of the upper portion of the body in the first direction and configured to advance in the first direction and retract in the direction opposite to the first direction.

* * * * *